US005275085A

United States Patent [19]

Hur

[11] Patent Number: 5,275,085

[45] Date of Patent: Jan. 4, 1994

[54] CONTROL DEVICE FOR PNEUMATIC CYLINDER

[76] Inventor: Young B. Hur, 615-34, Jayang-Dong, Seongdong-ku, Seoul, Rep. of Korea

[21] Appl. No.: 921,903

[22] Filed: Jul. 29, 1992

[30] Foreign Application Priority Data

| | | | |
|---|---|---|---|
| Aug. 1, 1991 | [KR] | Rep. of Korea | 91-13342 |
| Oct. 11, 1991 | [KR] | Rep. of Korea | 91-16902 |
| Oct. 11, 1991 | [KR] | Rep. of Korea | 91-17878 |
| Nov. 13, 1991 | [KR] | Rep. of Korea | 91-20164 |

[51] Int. Cl.[5] ..... F01B 1/00; F01L 15/12

[52] U.S. Cl. ..... 91/170 R; 91/224; 91/228; 92/181 P; 92/115

[58] Field of Search ..... 91/170; 92/181; 60/413

[56] References Cited

U.S. PATENT DOCUMENTS

| | | | |
|---|---|---|---|
| 220,625 | 10/1879 | Knecht | 91/224 |
| 1,470,462 | 10/1923 | Maiden | 91/182 |
| 3,390,616 | 7/1968 | Hammer | 91/224 |
| 3,592,108 | 7/1971 | Rosaen | 92/52 X |
| 3,664,636 | 5/1972 | Sherrill | 92/53 |
| 4,561,248 | 12/1985 | Quin et al. | 91/170 R X |
| 4,726,283 | 2/1988 | Miyamoto | 92/110 |
| 4,791,854 | 12/1988 | Banicevic | 92/52 X |
| 4,955,282 | 9/1990 | Ranson | 92/110 X |

FOREIGN PATENT DOCUMENTS

| | | | |
|---|---|---|---|
| 30328 | 10/1860 | France | 92/115 |
| 748295 | 4/1956 | United Kingdom | 91/228 |

*Primary Examiner*—Edward K. Look
*Assistant Examiner*—Hoang Nguyen
*Attorney, Agent, or Firm*—Nawrocki, Rooney & Sivertson

[57] ABSTRACT

A device for controlling a pneumatic cylinder device, being of a double cylinder construction comprising an outer cylinder and an inner cylinder sealably fitted in the outer cylinder to slide along the outer cylinder. In the inner cylinder, a piston with a valve at one side thereof or valves at both sides thereof is slidably disposed. To control the valve or valves, an adjusting rod is provided which is slidably and rotatably disposed in the piston and its piston rod and adjusted by an operating lever. Alternatively, the double cylinder construction comprises a pair of cylinders disposed axially in parallel to each other. In the cylinders, pistons are disposed, one of which has a valve at one side thereof or valves at both sides thereof. The cylinders are communicated with each other by a communication construction having a communication adjusting groove and an adjusting lever for adjusting the communication area of communication adjusting groove. In either case, controls of operation load, operation speed and braking are easily achieved during the compressing and stretching operations without requiring a separate device, by controlling the valve or valves and/or the communication adjusting groove.

10 Claims, 11 Drawing Sheets

CONTROL DEVICE FOR PNEUMATIC CYLINDER

BACKGROUND OF THE INVENTION

1. Field of the Invention

The present invention relates to a control device for a pneumatic cylinder using air as its operating medium, and more particularly to a control device for a pneumatic cylinder, capable of controlling the operation speed of the pneumatic cylinder upon reciprocation and braking the reciprocation.

2. Description of the Prior Art

In cases of hydraulic cylinders, an accurate controlling of operation speed and a reliable braking can be easily achieved by operating external valves for adjusting the quantity of supplied oil and shutting off the supplying of oil, the oil as operating medium has a high density characteristic. In cases of pneumatic cylinders, however, it is difficult to achieve an accurate controlling of operation speed and a reliable braking, due to a variation in internal volume of compressed air in the cylinder, which variation is caused by a phenomenon that the compressed air as operating medium varies greatly in density depending on a pressure applied thereto, due to its physical characteristic. In particular, since the speed controlling and braking under low pressure and speed condition are considerably unstable, such pneumatic cylinders are hardly applied to automatic installations and other appliances which require highly precise operations other than a simple reciprocation.

For overcoming the above-mentioned problems encountered in the pneumatic cylinders, there have been proposals of providing a separate auxiliary mechanical device such as a brake lining. However, the provision of such an auxiliary mechanical device causes the whole cylinder construction to be bulk and thus the installation work to be difficult. Furthermore, the cylinder becomes expensive, resulting in a difficulty in practical use.

SUMMARY OF THE INVENTION

Therefore, the present invention has been made in view of the above-mentioned prior art problem and an object of the invention is to provide a device for controlling a pneumatic cylinder device, capable of achieving precise and uniform controls of operation load, operation speed and braking of the pneumatic cylinder device and having various types such as a double cylinder type, parallel cylinder type and a single cylinder type.

Another object of the invention is to provide a pneumatic control device, capable of being incorporated in pneumatic cylinder devices requiring precise and uniform controls of operation load, operation speed and braking and being applied to appliances requiring a control of load, so as to achieve precise and uniform controls of operation load, operation speed and braking of the pneumatic devices.

Another object of the invention is to provide a device for controlling a pneumatic cylinder device, capable of achieving precise and uniform controls of operation load, operation speed and braking of the pneumatic cylinder device, without requiring an separate device for supplying a separate operating medium from external to the cylinder or discharging the operating medium from the cylinder to external, and capable of achieving mechanically the controls, thereby making the controls easy.

In one aspect, the present invention provides a device for controlling a pneumatic cylinder device comprising: an outer cylinder having an opened front end and an opened rear end; a cylinder block coupled to said rear end of the outer cylinder to close it, said cylinder block having an axial hole and a sector-shaped radial hole communicating with said axial hole; an inner cylinder sealably fitted in the outer cylinder to slide axially in the outer cylinder, said inner cylinder having a closed front end protruded forwardly from said front end of the outer cylinder and a rear end disposed in the outer cylinder and provided with a central throughout hole; seal means adapted to provide a seal at the opened front end of the outer cylinder; a piston sealably fitted in the inner cylinder to slide axially in the inner cylinder and dividing the interior of the inner cylinder into a front operating medium chamber and a rear operating medium chamber, said piston having a front end, a rear end and a central throughout hole; a hollow piston rod having a front end coupled to said rear end of the piston, a rear end coupled to said cylinder block, and a throughout hole; a plurality of axial communicating passages extending axially throughout the piston to permit an operating medium in the inner cylinder to flow freely between said front and rear operating medium chambers with each other, each of said axial communicating passages having a front end opened to the front operating medium chamber and a rear end opened to the rear operating medium; valve means adapted to open and close said axial communicating passages; and control means adapted to control a flow rate of the operating medium flowing between the front and rear operating medium chambers.

In another aspect, the present invention also provides a device for controlling a pneumatic cylinder device comprising: a first cylinder having an opened front end and an opened rear end; a second cylinder disposed in parallel to said first cylinder and having an opened front end and an opened rear end; a first front end member coupled to said front end of the first cylinder to close it; a second front end member coupled to said front end of the second cylinder and provided with an air communication port; a cylinder block coupled to said rear ends of the first and second cylinders and provided with a first axial throughout hole and a second axial throughout hole; a first piston sealably fitted in the first cylinder to slide axially in the first cylinder and dividing the interior of the first cylinder into a front operating medium chamber and a rear operating medium chamber, said piston having a front end, a rear end and a central throughout hole; a first piston rod having a front end coupled to said rear end of the first piston, a rear end extending backwardly beyond the cylinder block, and a throughout hole; a second piston sealably fitted in the second cylinder to slide axially in the second cylinder and defining together with the cylinder block an operating medium chamber in the interior of the cylinder; a second piston rod having a front end coupled to the second piston, a rear end extending backwardly beyond the cylinder block; a communicating passage provided in the cylinder block and adapted to communicate said rear operating medium chamber of the first cylinder and said operating medium chamber of the second cylinder; an adjusting lever adapted to adjust a flow rate of the operating medium passing through said communicating passage; a plurality of axial communicating passages extending axially throughout the piston to permit an operating medium in the first cylinder to flow freely between said front and rear operating medium chambers with each other, each of said axial communicating passages having a front end opened to the front operating medium chamber and a rear end opened to the rear operating medium; an adjusting block coupled to said rear ends of the first and second piston rods so as to make the first and second pistons move integrally with each other, said adjusting block having an axial hole and a sector-shaped radial hole communicating with said axial hole; valve means adapted to open and close said axial communicating passages; and control means adapted to control a flow rate of the operating medium flowing between the front and rear operating medium chambers of the first cylinder.

BRIEF DESCRIPTION OF THE DRAWINGS

Other objects and aspects of the invention will become apparent from the following description of embodiments with reference to the accompanying drawings in which:

FIGS. 1, 1A, 1B and 2 are sectional views of a device for controlling a pneumatic cylinder device in accordance with an embodiment of the present invention, wherein FIGS. 1, 1A and 1B shows a condition of enabling a control in operation speed during a stretching operation, while FIG. 2 shows a condition of enabling a control in operation speed during a compressing operation;

FIGS. 13 and 14 are sectional views of a control device with a construction modified in accordance with another embodiment of the present invention, wherein FIG. 13 shows a condition of enabling a control in operation speed during a compressing operation, while FIG. 14 shows a condition of enabling a control in operation speed during a stretching operation;

DETAILED DESCRIPTION OF THE PREFERRED EMBODIMENTS

Figures 1, 1A, 1B:
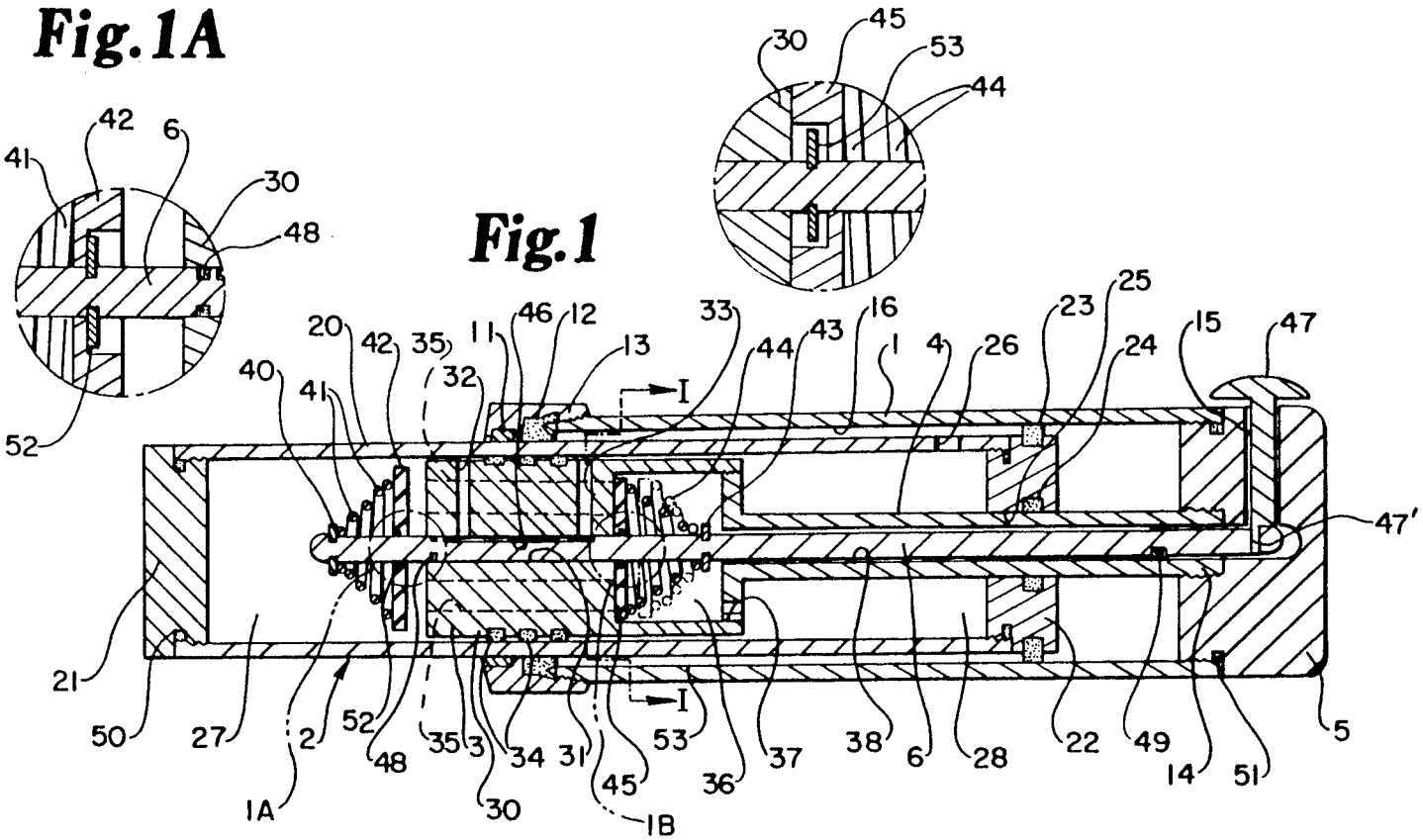
Figure 2:
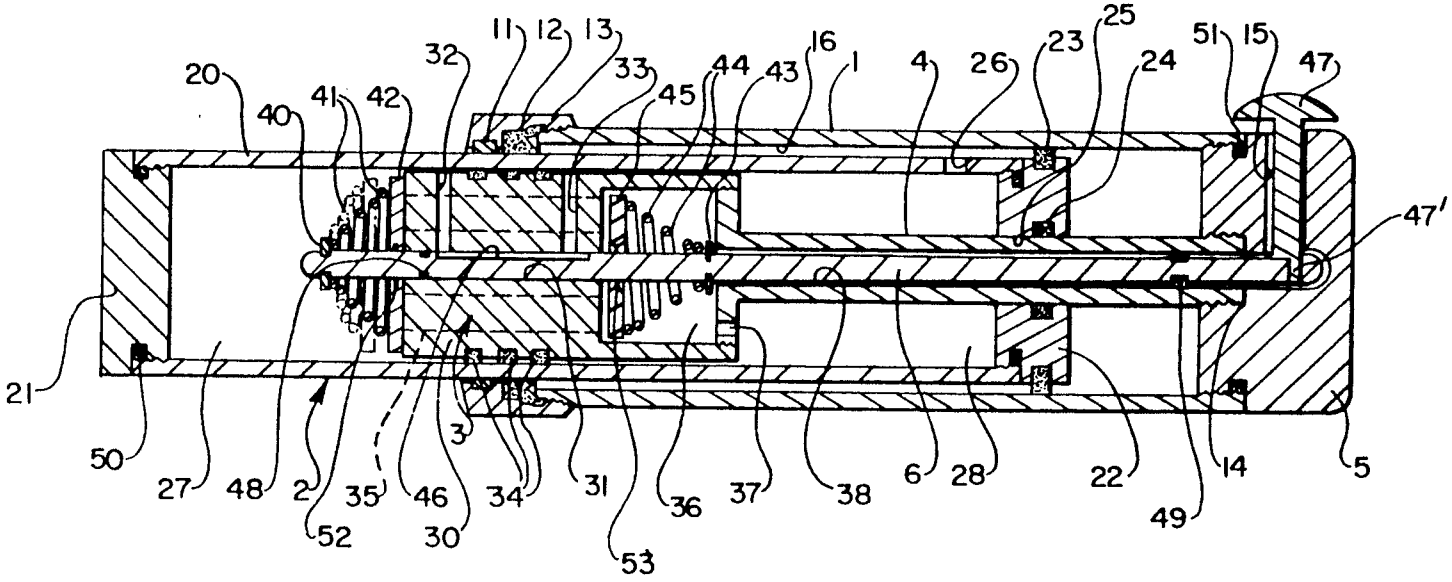

Referring to FIGS. 1 and 2, there is illustrated a device for controlling a pneumatic cylinder device in accordance with an embodiment of the present invention.

As shown in FIGS. 1 and 2, the device is of a double cylinder construction which comprises an outer cylinder 1 and an inner cylinder 2 sealably fitted in the outer cylinder 1. The inner cylinder 2 comprises a cylinder tube 20 which has a rear end disposed backwardly of the outer cylinder 1 and a front end disposed forwardly of the outer cylinder 1, that is, forwardly protruded through and beyond the front end of outer cylinder 1. In the inner cylinder 2, a piston 3 is fitted which has a hollow piston rod 4 protruded through and beyond the rear end of inner cylinder 2. At its rear end, the outer cylinder 1 has a cylinder block 5 mounted thereto and adapted to close the rear end of outer cylinder 1. The piston rod 4 is coupled at its rear end to the cylinder block 5. Throughout the piston 3 and piston rod 4, an adjusting rod 6 extends axially to have an front end protruded forwardly of the piston 3 and a rear end protruded backwardly of the rear end of piston rod 4.

To the front end of outer cylinder 1, an annular seal member 13 is threadedly coupled which has a wear ring 11 and a seal ring 12. The cylinder block 5 is provided with an axial stepped hole 14 having a threaded hole portion receiving the rear end of piston rod 4 and a sector-shaped operating hole 15 extending radially and communicating with the axial stepped hole 14.

Figure 3:
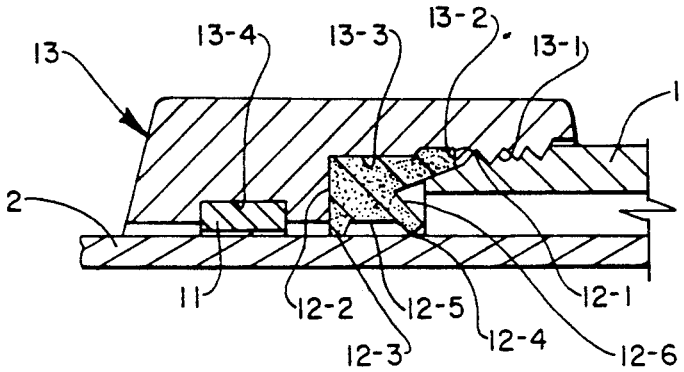
FIG. 3 is an enlarged sectional view of a seal member and a seal ring fitted around an outer cylinder of the device shown in FIGS. 1 and 2.

As shown in FIG. 3, the annular seal member 13 has at its rear end an inner threaded taper portion 13-1 adapted to be threadedly coupled to an outer threaded taper portion formed on the front end of outer cylinder 1. Backwardly of the inner threaded taper portion 13-1, the annular seal member 13 also has a first annular groove 13-2 and a second annular groove 13-3 both adapted to fit the seal ring 12 therein, and a third annular groove 13-4 adapted to fit the wear ring 11 therein. The seal ring 12 which is fitted in the first and second annular grooves 13-2 and 13-3 includes a rear end portion 12-1, a front end portion 12-2, a dust rip 12-3 extending radially from the front end portion 12-2 and an oil rip 12-4 extending radially from a seal ring portion between the rear end portion 12-1 and the front end portion 12-2. Recesses 12-5 and 12-6 are defined between the dust rip 12-3 and the oil rip 12-4 and between the oil rip 12-4 and the rear end portion 12-1, respectively. After coupling, the rear end portion 12-1 of seal ring 12 is pressing fitted in the first annular groove 13-2 of annular seal member 13, whereas the front end portion 12-2 of seal ring 12 is in pressing contact with the facing surface of the second annular groove 13-3. Also, the dust rip 12-3 is in pressing contact with the outer circumferential surface of the cylinder tube 20, so as to prevent incoming of dust from external, whereas the oil rip 12-4 is in pressing contact with the outer circumferential surface of the cylinder tube 20, so as to prevent leakage of inner operating fluid, that is, oil.

As shown in FIGS. 1 and 2, the inner cylinder 2 is maintained at sealed condition, by a pair of cylinder blocks 21 and 22 fitted in both ends of the inner cylinder 2. The inner cylinder block 22 has a central throughout hole 25 through which the piston rod 4 extends. An outer seal ring 23 is fitted around the outer circumferential surface of the inner cylinder block 22 and adapted to define together with the seal ring 12 an annular operating medium chamber 16 between the inner circumferential surface of cylinder 1 and the outer circumferential surface of cylinder 2. An inner seal ring 24 is also fitted around the inner circumferential surface of the inner cylinder block 22, so as to maintain a seal at the central throughout hole 25 of inner cylinder block 22 during when the inner cylinder 2 moves reciprocally along the piston rod 4. On the other hand, a operating medium communicating port 26 is provided at the cylinder tube 20, so as to communicate the interior of inner cylinder 2 with the annular operating medium chamber 16.

Figure 4:
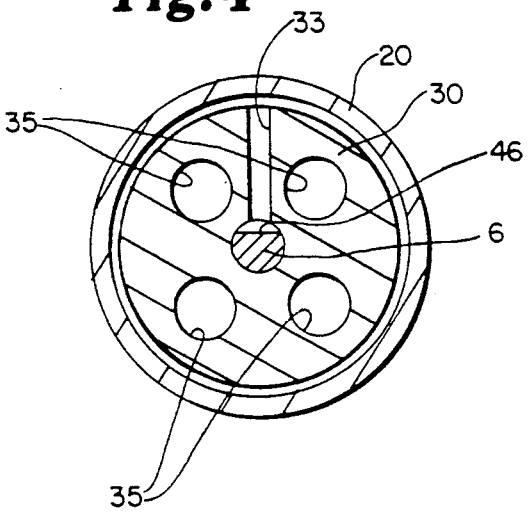
FIG. 4 is a cross-sectional view taken along the line I—I of FIG. 1, showing an operation at a maximum operation speed.
Figure 5:
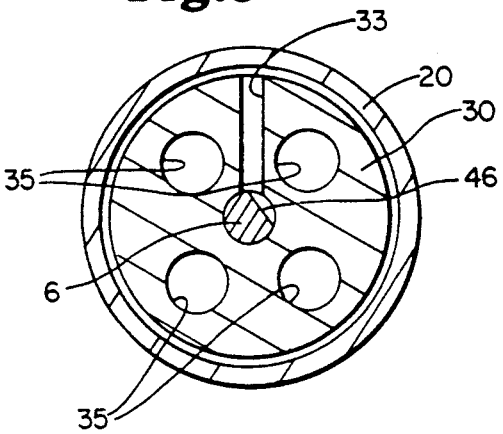
FIG. 5 is a cross-sectional view taken along the line II—II of FIG. 13, showing an operation at a medium operation speed.
Figure 6:
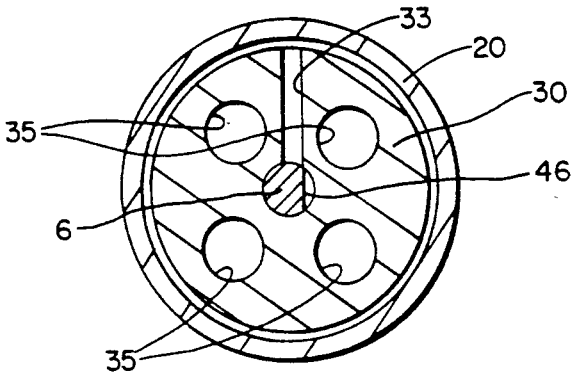
FIG. 6 is a cross-sectional view taken along the line III—III of FIG. 16, showing a braking operation.

As shown in FIGS. 1 and 2, and in particular, in FIGS. 4 to 6, the piston 3 comprises a piston body 30 threadedly coupled at its rear end to the front end of piston rod 4. The piston body 30 includes a central throughout hole 31 through which the adjusting rod 6 passes, and a pair of axially spaced radial communicating passages 32 and 33 extending from the outer circumferential surface of the piston body to the central throughout hole 31. Between the radial communicating passages 32 and 33, a plurality of axially spaced seal rings 34 are fitted around the outer circumferential surface of piston body 30. By these seal rings 34, the interior of inner cylinder 2 is divided into two operating medium chambers 27 and 28 arranged at both sides of the piston 3. A plurality of axially extending communicating passages 35 are formed in the piston body 30 to be arranged uniformly along a circle having a radius less than that of the piston body 30. The front end of each communicating passage 35 is open to the front operating medium chamber 27. At the rear portion of piston body 30, a valve receiving chamber 36 is provided which is closed at its rear end by the front end of piston rod 4 coupled to the rear end of piston body. The valve receiving chamber 36 is communicated at its front end with the axial communicating passages 35 and thus communicated with the front operating medium chamber 27 via the axial communicating passages 35. The piston rod 4 has at its front end a communicating port 37 which serves to communicate the valve receiving chamber 36 with the rear operating medium chamber 28. For extending the adjusting rod 6, the piston rod 4 also has an axial throughout hole 38 axially aligned with the axial throughout hole 31 of piston body 30.

As shown in FIGS. 1 and 2, detailed in FIGS. 1A and 1B, and in particular, in FIGS. 4 to 6, the adjusting rod 6 axially extends through the axial throughout hole 31 of piston body 30, the axial throughout hole 38 of piston rod 4 and the axial stepped hole 14 of cylinder block 5 such that its front and rear ends extend forwardly beyond the piston 3 and backwardly beyond the piston rod 4, respectively. In the throughout holes 31, 38 and 14, the adjusting rod 6 is able to rotate and axially move.

In order to selectively open and close both ends of respective axial communicating passages 35, a pair of valves are provided at the front operating medium chamber 27 and the valve receiving chamber 36, respectively. The valve for selectively opening and closing front ends of axial communicating passages 35 comprises a valve seat 42 slidably fitted around the protruded front end portion of adjusting rod 6 near the front ends of axial communicating passages 35, a snap ring 40 fixedly fitted around the protruded front end of adjusting rod 6 and spaced forwardly apart from the valve seat 42, and a compression coil spring 41 disposed around the protruded front end portion of adjusting rod 6 between the snap ring 40 and the valve seat 42 and adapted to urge the valve seat 42 backwardly. In order to limit the backward sliding movement of the valve seat 42 to a predetermined position, a snap ring 52 is fixedly fitted around the front end portion of adjusting rod 6 at the same position. In similar, the valve for selectively opening and closing rear ends of axial communicating passages 35 comprises a valve seat 45 slidably fitted around the portion of adjusting rod 6 disposed in the valve receiving chamber 36 near the rear ends of axial communicating passages 35, a snap ring 43 fixedly fitted around the portion of adjusting rod 6 in the valve receiving chamber 36 and spaced backwardly apart from the valve seat 45, and a compression coil spring 44 disposed around the portion of adjusting rod 6 between the snap ring 43 and the valve seat 45 and adapted to urge the valve seat 45 forwardly. In order to limit the forward sliding movement of the valve seat 45 to a predetermined position, a snap ring 53 is fixedly fitted around the portion of adjusting rod 6 at the same position. According to axial positions of the adjusting rod 6, the valves mentioned above are opened at one and closed at the other, and vice versa.

The adjusting rod 6 also has a communication adjusting groove 46 formed axially at a portion of the circumferential surface of the adjusting rod portion axially extending between the radial communicating passages 32 and 33. The communication adjusting groove 46 serves to communicate the radial communicating passages 32 and 33 with each other selectively according to the rotation of the adjusting rod 6, but irrespective of the axial movement of the adjusting rod 6.

Figure 7:
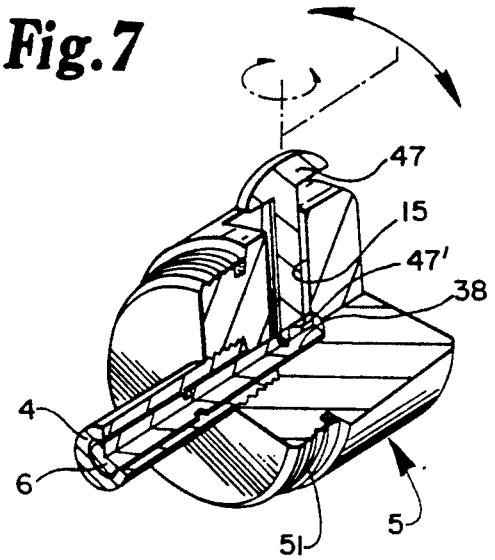
FIG. 7 is a partially broken-out perspective view of a cylinder block fitted to the rear end of outer cylinder of FIGS. 1 and 2, showing operations of an operating lever according to the present invention.

To the rear end of adjusting rod 6 received in the axial hole 14 of cylinder block 5, an operating lever 47 is connected which is received in the sector-shaped operating hole 15 of cylinder block 5. As shown in FIG. 7, the operating lever 47 is provided at its lower end with an eccentric shaft, namely a cam shaft 47' received in a cam groove (denoted by no reference numeral) formed at the rear end of adjusting rod 6. As will be described, the operating lever 47 can rotate and move along the sector-shaped operating hole 15 to carry out rotating and camming operations causing the adjusting rod 6 to rotate and axially move.

In order to maintain a seal during the rotation and axial movement, the adjusting rod 6 is provided with a pair of O-rings 48 and 49 disposed near the front and rear ends respectively.

In FIGS. 1 and 2, the reference numerals 50 and 51 denote O-rings fitted around the cylinder blocks 21 and 5, respectively.

Figure 8:
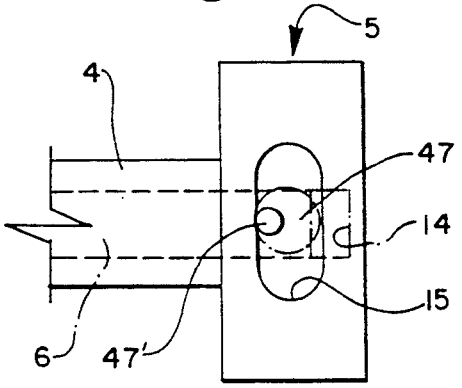
FIGS. 8 to 10 are schematic view showing the movements of an adjusting rod according to the operations of operating lever.

In the above-mentioned construction, when the cylinders 1 and 2 are required to be pulled from each other, that is, to move to their stretched positions, the operating lever 6 is first rotationally adjusted to be positioned at its front position shown in FIGS. 1 and 8. At the front position, the adjusting rod 6 is maintained as having been forwardly moved along the axial throughout holes 31 and 38. At this time, the valve seat 45 is in contact with the facing rear end surface of piston body 30 to close the rear ends of axial communicating passages 35, while the valve seat 42 is spaced apart from the facing front end surface of piston body 30 to open the front ends of axial communicating passages 35.

As the cylinders 1 and 2 are pulled from each other to move to their stretched positions under the above-mentioned condition, the internal operating medium, such as compressed air, contained in the operating medium chambers 16 and 28 and the valve receiving chamber 36 is forced to flow into the front operating medium chamber 27 via the radial communicating passage 33, the axial communication adjusting groove 46 and the radial communicating passage 32. At this time, there is no flow of the operating medium through the axial communicating passages 35, since the rear ends of axial communicating passages 35 is maintained at their closed state by the valve seat 45 urged against the facing rear end surface of piston body 30 by the force of compression spring 44. The flow rate of the operating medium can be adjusted by controlling the communication area of the axial communication adjusting groove 46, as shown in FIGS. 4 to 6. This control can be achieved by rotating the adjusting rod 6 according to the movement of operating lever 47 along the sector-shaped operating hole 15. By adjusting the flow rate of the operating medium, it is possible to obtain operations in various modes, that is, a high speed operation as shown in FIG. 4, a medium speed operation as shown in FIG. 5 and a braking operation as shown in FIG. 6. Although not shown, the operation can be controlled at various speeds by precisely adjusting the communication area of axial communication adjusting groove 46 according to the movement angle of operating lever 47.

When the cylinders 1 and 2 are pushed toward each other to return to their original retracted positions under the above-mentioned condition, the operating medium contained in the front operating medium chamber 27 exerts a pressure in the axial communicating passages 35 and urge backwardly the valve seat 45 at the rear ends of axial communicating passages 35, against the force of compression spring 44, as indicated by the dotted line of FIG. 1, thereby causing the axial communicating passages 35 to be opened at their rear ends. Accordingly, the operating medium from the front operating medium chamber 27 can be allowed to flow through the opened axial communicating passages 35 into the valve receiving chamber 36 and the operating medium chambers 16 and 28. The operating medium is also allowed to flow into the rear operating medium chamber 28 through the still opened radial communicating passage 32, axial communication adjusting groove 46 and radial communicating passage 33. However, the flow rate of operating medium in the latter case is very small and a main part of the operating medium flows into the rear operating medium chamber 28 through the axial communicating passages 35. As a result, the flowing of operating medium can be easily carried out, so that the return of cylinders 1 and 2 can be easily achieved with few load.

Where controls in operating pressure and operation speed are required during the return operation of cylinders 1 and 2, the axial communicating passages 35 are closed at their front ends to permit the operating medium in the front operating medium chamber 27 to flow into the rear operating medium chamber 28 through the radial communicating passage 32, axial communication adjusting groove 46 and radial communicating passage 33, as shown in FIG. 2. The closing of axial communicating passages 35 is achieved by rotating the operating lever 47 from the position shown in FIG. 8 via the position shown in FIG. 9 to the position shown in FIG. 10 in clockwise through an angle of 180°. That is, the rotation of operating lever 47 causes the adjusting rod 6 to move backwardly along the axial throughout holes 31 and 38, so that the valve seat 42 comes into contact with the facing front end surface of piston body 30 and thus closes the front ends of axial communicating passages 35. Under this condition, as the cylinders 1 and 2 are pushed toward each other to return to their retracted positions, the operating medium in the front operating medium chamber 27 flows into the rear operating medium chamber 28 totally through the radial communicating passage 32, axial communication adjusting groove 46 and radial communicating passage 33. Therefore, it is possible to control the operation speed and obtain the braking operation by properly adjusting the axial communication adjusting groove 46 according to the rotation of the adjusting rod 6 caused by the adjustment of operating lever 47 along the sector-shaped operating hole 15.

When the cylinders 1 and 2 are pulled again from each other to move to their stretched positions under the condition that the axial communicating passages 35 are still closed at their front ends, the operating medium contained in the valve receiving chamber 36 and rear operating medium chamber 28 exerts a pressure in the axial communicating passages 35 and urge forwardly the valve seat 42 at the front ends of axial communicating passages 35, against the force of compression spring 41, as indicated by the dotted line of FIG. 2, thereby causing the axial communicating passages 35 to be opened at their front ends. Accordingly, a main part of the operating medium from the rear operating medium chamber 28 can be allowed to flow through the opened axial communicating passages 35 into the front operating medium chamber 27, although a very small part of the operating medium passes through the radial communicating passage 33, axial communication adjusting groove 46 and radial communicating passage 32. As a result, the flowing of operating medium can be easily carried out, so that the movements of cylinders 1 and 2 to their stretched positions can be easily achieved with few load.

Figure 11:
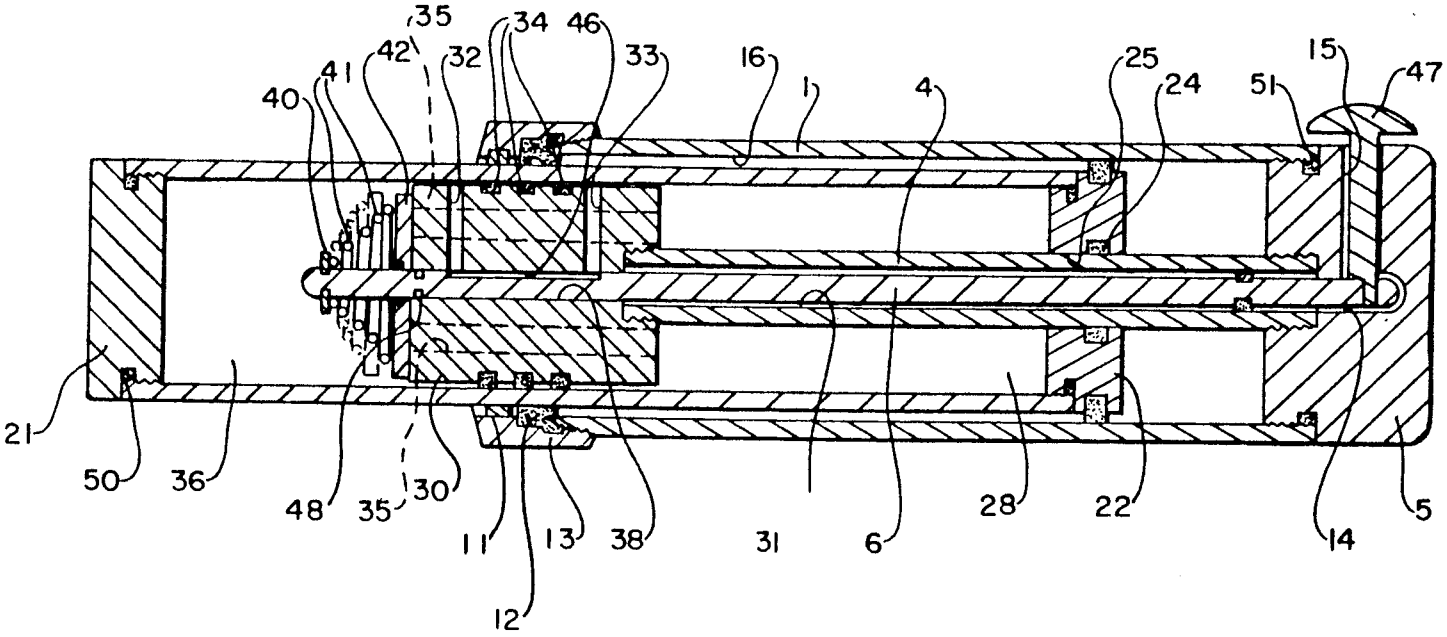
FIGS. 11 and 12 are control devices with constructions modified from that of FIGS. 1 and 2, in accordance with other embodiments of the present invention, respectively.
Figure 12:
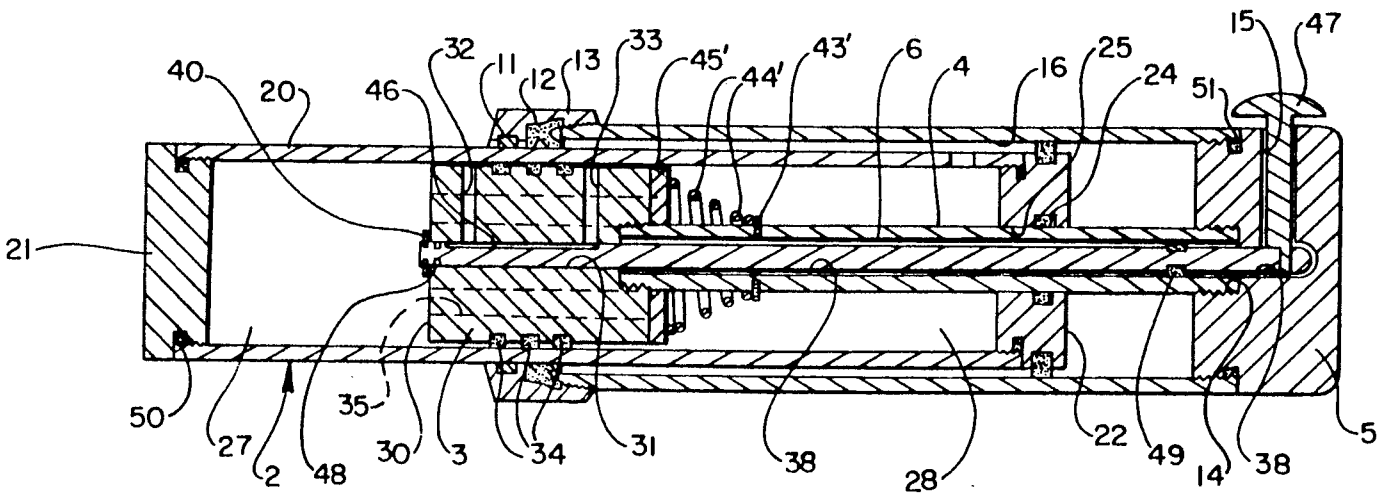

Referring to FIGS. 11 and 12, there are illustrated control devices with constructions modified from that of FIGS. 1 and 2, in accordance with other embodiments of the present invention. The devices of FIGS. 11 and 12 have the same constructions as those of FIGS. 1 and 2, except that they have no valve at the rear side of piston and the front side of piston, respectively. The constructions of FIGS. 11 and 12 identical or similar to those of FIGS. 1 and 2 are denoted by the same reference numeral as used in FIGS. 1 and 2.

In the embodiment of FIG. 11, the piston body 30 of the piston 3 has the central throughout hole 31, a pair of axially spaced radial communicating passages 32 and 33, the seal ring 34, a plurality of axial communicating passages 35 and the axial throughout hole 38, in similar to the above-mentioned basic embodiment. However, the piston body 30 has no valve receiving chamber such as the valve receiving chamber 36 of the basic embodiment. The piston rod 4 which is threadedly connected at its rear end to the threaded axial hole 14 of the cylinder block 5 has a front end which has no construction for providing a communicating port such as the communication port 37 of the basic embodiment. The front end of piston rod 4 is threadedly coupled to a threaded hole formed at the rear end of piston body. The adjusting rod 6 which extends axially through the axial throughout hole 31 of piston body 30 and the axial throughout hole 38 of piston rod 4 has a front end forwardly protruded beyond the piston body 30 and carrying the construction of valve, that is, the snap ring 40, the compression spring 41 and the valve seat 42, in similar to the basic embodiment. Since the embodiment of FIG. 11 has no valve at the rear side of piston 3, the adjusting rod 6 does not carry the construction including the snap ring 43, the compression spring 44 and the valve seat 45. In similar to the basic embodiment, the adjusting rod 6 of this embodiment also has the communication adjusting groove 46.

The device of FIG. 11 is exclusively used where controls in operating pressure and operation speed are required when the cylinders 1 and 2 are pushed toward each other to move to their retracted positions. Under the condition that the axial communicating passages 35 are closed at their front ends, as shown in FIG. 11, by rotating the operating lever 47 to the position shown in FIG. 10, that is, that the operating medium in the front operating medium chamber 27 is forced totally to flow into the rear operating medium chamber 28 through the radial communicating passage 32, axial communication adjusting groove 46 and radial communicating passage 33, during the movements of cylinders 1 and 2 to their retracted position, it is possible to control the operation speed and obtain the braking operation, by properly adjusting the communication area of axial communication adjusting groove 46 according to the rotation of the adjusting rod 6 caused by the adjustment of operating lever 47 along the sector-shaped operating hole 15, as shown in FIGS. 4 to 6. Of course, the movements of cylinders 1 and 2 to their retracted positions can be easily carried out with few load, when the axial communicating passages 35 are opened at their front ends. On the other hand, when the cylinders 1 and 2 are pulled from each other to move to their stretched positions, the operating medium contained in the rear operating medium chamber 28 exerts a pressure in the axial communicating passages 35 and urge forwardly the valve seat 42 at the front ends of axial communicating passages 35, against the force of compression spring 41, as indicated by the dotted line of FIG. 11, thereby causing the axial communicating passages 35 to be opened at their front ends. Accordingly, a main part of the operating medium from the rear operating medium chamber 28 can be allowed to flow through the opened axial communicating passages 35 into the front operating medium chamber 27, so that the movements of cylinders 1 and 2 to their stretched positions can be easily achieved with few load.

In the embodiment of FIG. 12, the piston 3 has no valve receiving chamber such as the valve receiving chamber 36 of the basic embodiment, in similar to the embodiment of FIG. 11. Differently from the embodiment of FIG. 11, the device of FIG. 12 has, at the rear side of piston 3, a valve construction including a snap ring 43', a compression spring 44' and a valve seat 45' which are similar to those of the basic embodiment. However, it is noted that the valve construction in this embodiment is carried by the piston rod, differently from that of the basic embodiment wherein the valve construction is carried by the adjusting rod 6. In this embodiment, accordingly, it is impossible to achieve an adjustment for optionally opening the rear ends of axial communicating passages 35. In this embodiment, the adjusting rod 6 carries, at its front end, no valve construction such as the compression spring 41 and valve seat 42 of the embodiment of FIG. 11. However, the snap ring 40 is provided for limiting the axial movement of adjusting rod 6 to a desired distance. Other construction of the present embodiment are identical to those of FIG. 12.

The device of FIG. 12 is exclusively used where controls in operating pressure and operation speed are required when the cylinders 1 and 2 are pulled from each other to move to their stretched positions. Under the condition that the axial communicating passages 35 are closed at their rear ends, as shown in FIG. 12, by rotating the operating lever 47 to the position shown in FIG. 8, that is, that the operating medium in the rear operating medium chamber 28 is forced totally to flow into the front operating medium chamber 27 through the radial communicating passage 33, axial communication adjusting groove 46 and radial communicating passage 32, during the movements of cylinders 1 and 2 to their stretched position, it is possible to control the operation speed and obtain the braking operation, by properly adjusting the communication area of axial communication adjusting groove 46 according to the rotation of the adjusting rod 6 caused by the adjustment of operating lever 47 along the sector-shaped operating hole 15, as shown in FIGS. 4 to 6. On the other hand, when the cylinders 1 and 2 are pushed toward each other to move to their retracted positions, the operating medium contained in the front operating medium chamber 27 exerts a pressure in the axial communicating passages 35 and urge backwardly the valve seat 45' at the rear ends of axial communicating passages 35, against the force of compression spring 44', thereby causing the axial communicating passages 35 to be opened at their rear ends. Accordingly, a main part of the operating medium from the front operating medium chamber 27 can be allowed to flow through the opened axial communicating passages 35 into the rear operating medium chamber 28, so that the movements of cylinders 1 and 2 to their retracted positions can be easily achieved with few load.

Figure 13:
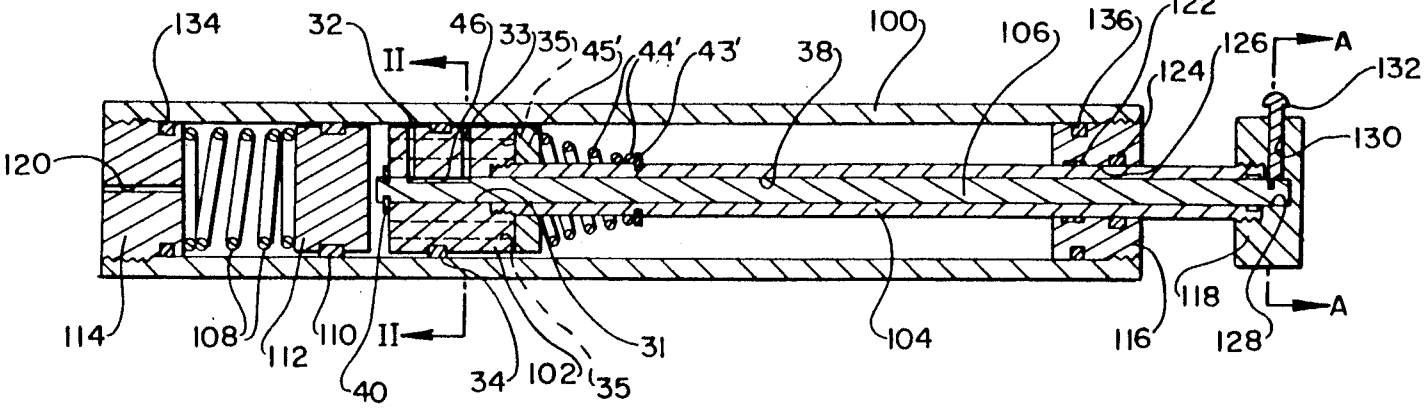
Figure 14:
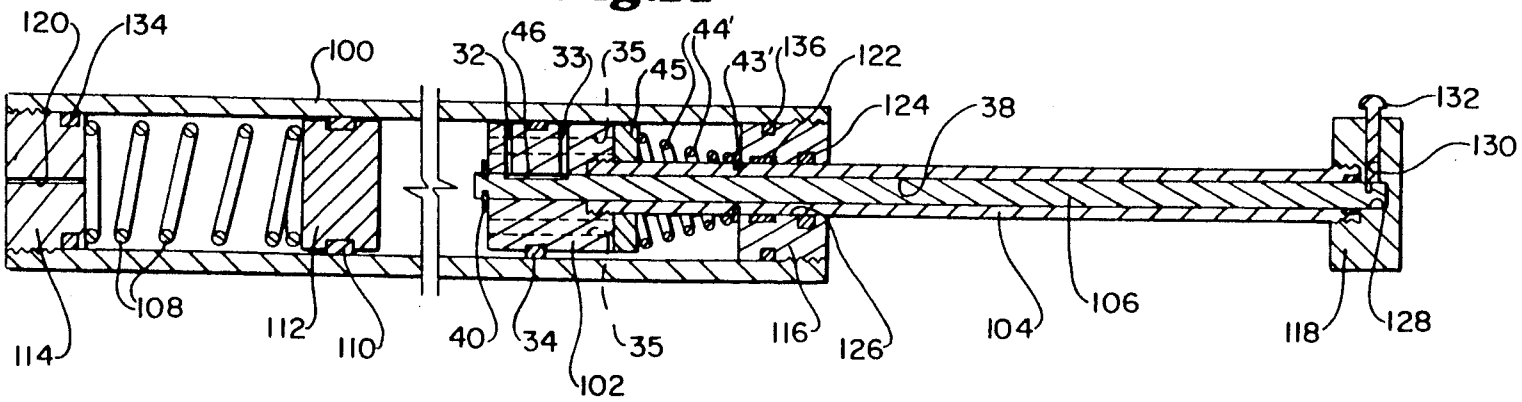
Figure 15:
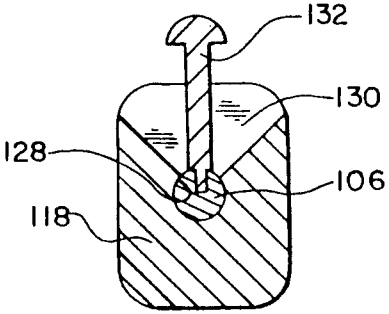
FIG. 15 is a cross-sectional view taken along the line A—A of FIG. 13.

FIGS. 13 to 15 illustrate a control device with a construction modified from those of the above-mentioned embodiments, in accordance with another embodiment of the present invention. The constructions of FIGS. 13 to 15 identical or similar to those of FIGS. 1 and 2 are denoted by the same reference numeral as used in FIGS. 1 and 2.

As shown in FIGS. 13 and 14, the control device comprises a cylinder tube 100 in which a piston 102 is slidably disposed. A piston rod 104 is threadedly coupled at its front end to the rear end of piston 102. In similar to those of the above-mentioned embodiments, the piston 102 and the piston rod 104 have axial throughout holes 31 and 38, respectively, through which an adjusting rod 106 extends axially to rotate. To both ends of the cylinder tube 100, end members 114 and 116 are threadedly coupled, respectively. In the cylinder tube 100, a reciprocating block 112 is slidably disposed between the front end member 114 and the piston 102. Between the front end member 114 and the reciprocating block 112, a compression spring 108 is disposed to urge the reciprocating block 112 backwardly, namely, toward the piston 102. A seal ring 110 is fitted around the outer circumferential surface of reciprocating block 112.

The front end member 114 has an air communication port 120 for communicating a space defined between the front end member 114 and the reciprocating block 112 in the cylinder tube 100, with external, so that the space is maintained under atmosphere pressure. The rear end member 116 has a throughout hole 126 through which the piston rod 104 moves reciprocally and is protruded backwardly. To provide a seal at the throughout hole 126, a pair of spaced seal rings 122 and 124 are disposed around the inner circumferential surface of rear end member 116. To the protruded rear end of piston rod 104, an adjusting block 118 is threadedly coupled which has an axial hole 128 for receiving the protruded rear end of adjusting rod 106. The remaining constructions of piston rod 104 and adjusting rod 106 and the whole construction of piston 102 are the same as those of the embodiment shown in FIG. 12. Therefore, detailed description thereof is omitted herein.

The adjusting block 118 is also provided with a sector-shaped radial operating hole 130 communicating with the axial hole 128, as shown in FIG. 15. In the operating hole 130, an operating lever 132 is received which is coupled to the rear end of adjusting rod 104 in such a manner that it carries out an adjustment causing the adjusting rod 6 to rotate, as in the above-mentioned embodiments.

In FIGS. 13 and 14, the reference numerals 134 and 136 denote seal rings fitted around outer circumferential surfaces of end members 114 and 116, respectively.

The device of the present embodiment is exclusively used where controls in operating pressure and operation speed are required when a stretching operation is carried out. When the device moves from the retracted state shown in FIG. 13 to the stretched state shown in FIG. 14, the operating medium contained in a rear chamber defined between the piston 102 and the rear end member 116 in the cylinder tube 100 is forced to flow into a front chamber defined between the piston 102 and the reciprocating block 112, through the radial communicating passage 33, axial communication adjusting groove 46 and radial communicating passage 32. At this time, it is possible to control the operation speed and obtain the braking operation, by properly adjusting the communication area of axial communication adjusting groove 46 according to the rotation of the adjusting rod 106 caused by the adjustment of operating lever 132 along the sector-shaped operating hole 130, as shown in FIGS. 4 to 6. Since the cross-section of the rear chamber is smaller than the cross-section of the front chamber in that the piston rod 106 is disposed throughout the axial length of the rear chamber, the chambers are different from each other in terms of the volume per length. This difference is offset by a backward movement of the reciprocating block 112 caused by the urging force of compression spring 108. Thus, the stretching operation is smoothly carried out.

On the other hand, when the device moves from the stretched state shown in FIG. 14 to the retracted state shown in FIG. 13, the operating medium contained in the front chamber exerts a pressure in the axial communicating passages 35 of piston 102 and urge backwardly the valve seat 45' at the rear ends of axial communicating passages 35, against the force of compression spring 44', thereby causing the axial communicating passages 35 to be opened at their rear ends. Accordingly, a main part of the operating medium from the front chamber can be allowed to flow through the opened axial communicating passages 35 into the rear chamber, so that the device returns to the state shown in FIG. 13. without any considerable resistance. The reciprocating block 112 also returns to its original position shown in FIG. 13, against the force of compression spring 108.

As apparent from the above description, the device of the present embodiment enables the controls in operating pressure and operation speed, only when a stretching operation is carried out.

Referring to FIGS. 16 to 19, there is illustrated a control device with a construction modified from those of the above-mentioned embodiments, in accordance with another embodiment of the present invention. The constructions of FIGS. 16 to 19 identical or similar to those of FIGS. 1 and 2 are denoted by the same reference numeral as used in FIGS. 1 and 2.

Figure 16:
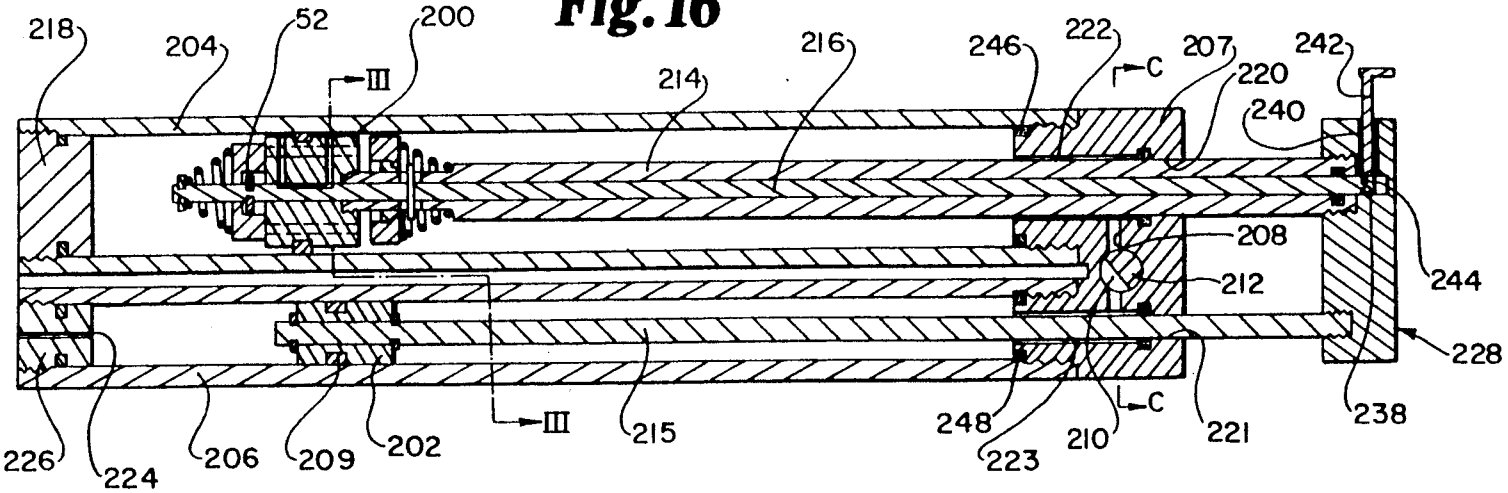
FIG. 16 is a sectional view of a control device with a construction modified in accordance with another embodiment of the present invention.

In this embodiment, the control device is of a double cylinder construction which comprises a pair of cylinders 204 and 206 disposed axially in parallel to each other and fixedly mounted together to a cylinder block 207, as shown in FIG. 16.

Figure 17:
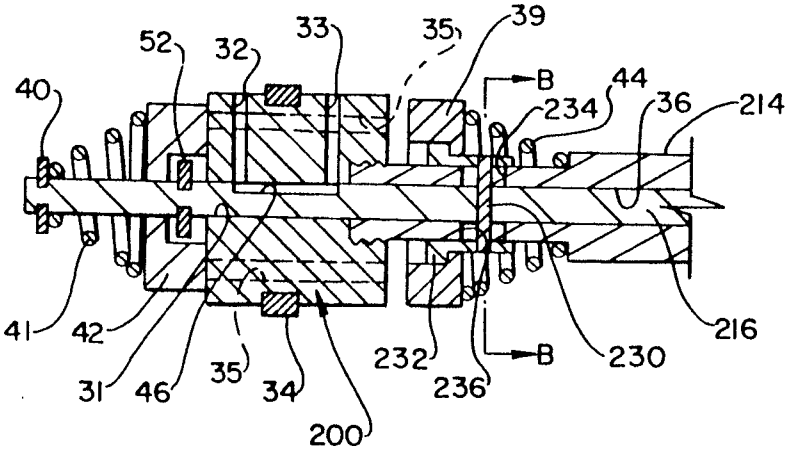
FIG. 17 is an enlarged sectional view of a first piston and valves of the control device shown in FIG. 16.
Figure 19:
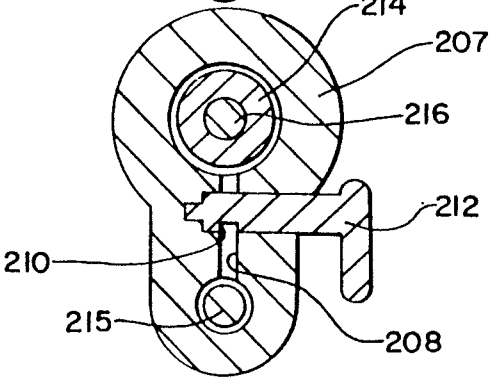
FIG. 19 is a cross-sectional view taken along the line C—C of FIG. 16.

A piston 200 is slidably disposed in the cylinder 204. As shown in FIG. 17, the piston 200 has a central throughout hole 31, a pair of axially spaced radial communicating passages 32 and 33 communicating with the central throughout hole 31, a piston ring 34 fitted around the outer circumferential surface of the piston 200, and a plurality of axial communicating passages 35, as in the above-mentioned embodiments. To the rear end of piston 200, a piston rod 214 is threadedly coupled. Through the central throughout hole 31 of piston 200, an adjusting rod 216 extends axially. The adjusting rod 216 also extends through the piston rod 216. In the cylinder 206, a piston 202 is slidably disposed which has a piston ring 209 fitted around its outer circumferential surface. A piston rod 214 is coupled to the piston 202.

An end member 218 is threadedly coupled to the front end of cylinder 204 to close the same end. Another end member 226 is threadedly coupled to the front end of cylinder 206 to close the same end. Differently from the end member 218, the end member 226 has an air communication port 224 for communicating a space defined between the end member 226 and the piston 202 in the cylinder 206, with external, so that the space is maintained under atmosphere pressure. The other ends of cylinders 204 and 206 are closed by the cylinder block 207 threadedly coupled thereto.

Figure 18:
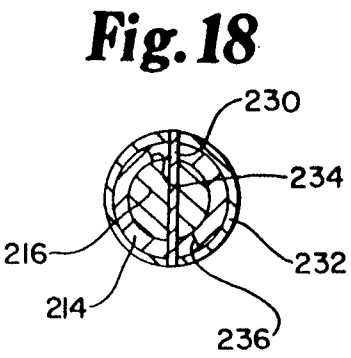
FIG. 18 is a cross-sectional view taken along the line B—B of FIG. 17.

The piston rod 214 which is threadedly coupled at its front end to the piston 200 has an axial throughout hole 36 (FIG. 17) through which the adjusting rod 216 extends axially. At the front end of piston rod 214, a valve is disposed which serves to open and close the rear ends of axial communicating passages 35 formed in the piston 200. The piston rod 214 is provided at its front end with a smaller diameter portion for fitting the valve therearound and a pair of radially aligned holes 234 and 236 communicating with the throughout hole 36, as shown in FIG. 18. Each of the holes 234 and 236 has a predetermined axial length and a predetermined peripheral length. The valve comprises a sliding member 232 slidably fitted around the smaller diameter portion of piston rod 214 and provided at its front end with an engaging portion. The sliding member 232 is also fixedly mounted to a protruding pin 230 which is fixed to the adjusting rod 216 and protruded through the holes 234 and 236 of piston rod 214. With this construction, the sliding member 232 slides axially along the smaller diameter portion of piston rod 214 as the protruding pin 230 moves axially in the holes 234 and 236 by the axial movement of adjusting rod 216. By the provision of holes 234 and 236 having the predetermined axial length and the predetermined peripheral length, the axial and rotational movements of adjusting rod 216 and thus the movements of sliding member 232 are carried out without any interference with the piston rod 214. The valve also comprises a valve seat 39 slidably fitted around the sliding member 232 and provided at its rear end with an engaging portion selectively engagable with the engaging portion of sliding member 232, and a compression spring 44 disposed around the smaller diameter portion of piston rod 214 and adapted to urge always the valve seat 39 forwardly, namely, toward the direction of closing the rear ends of axial communicating passages 35 of the piston 200. The compression spring 44 also urges always the valve seat 39 such that the engaging portion of valve seat 39 is engaged with the engaging portion with the sliding member 232.

The adjusting rod 216 which extends axially through throughout holes 31 and 36 of the piston 200 and piston rod 214 has a front end protruded forwardly beyond the front end of piston 200. The adjusting rod 216 also has a communication adjusting groove 46 which is the same as that of the basic embodiment of FIGS. 1 and 2. Accordingly, detailed description of the construction and function of the communication adjusting groove 46 is omitted.

At the front end of adjusting rod 216, another valve is disposed which serves to open and close the front ends of axial communicating passages 35 of the piston 200. The valve comprises a snap ring 40, a compression spring 41, a valve seat 42 and a snap ring 52. These elements of the valve are the same as those of the basic embodiment of FIGS. 1 and 2, and thus their detailed description is omitted.

The cylinder block 207 has a pair of throughout holes 220 and 221 through which the piston rods 214 and 215 extend backwardly beyond the cylinder block 207. The throughout holes 220 and 221 has large diameter portions for providing annular communicating passages 222 and 223 around the portions of piston rods 214 and 215 disposed in the cylinder block 207. The cylinder block 207 also has a communicating passage 208 communicating at both ends thereof with the annular communicating passages 222 and 223 to communicate the interiors of cylinders 204 and 206 with each other.

An adjusting lever 212 is fitted in the cylinder block 207 and provided with a communication adjusting groove 210 which is selectively aligned with the communicating passage 208 according to the rotational adjustment of adjusting lever 212, to open the communicating passage 208. The adjusting lever 212 can adjust the opening of the communicating passage 208.

Figure 9:
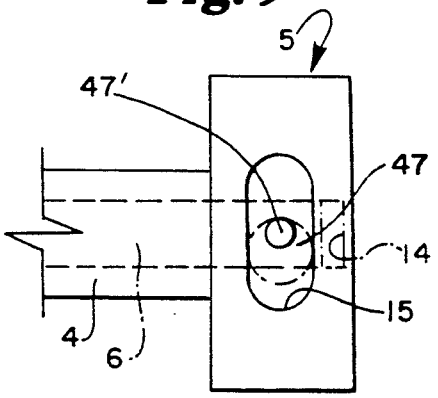
Figure 10:
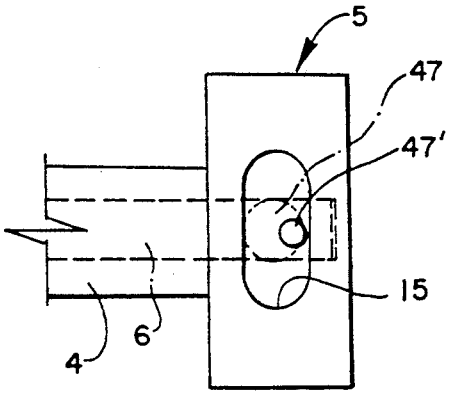

A fixed block 228 is threadedly coupled to the rear ends of piston rods 214 and 215 protruded backwardly beyond the cylinder block 207. The block 228 has an axial hole 238 receiving the rear end of adjusting rod 216 which is protruded backwardly beyond the rear end of piston rod 214. The block 228 also has a sector-shaped operating hole 240 extending radially and communicating with the axial hole 238. To the rear end of adjusting rod 216 received in the axial hole 238 of block 228, an operating lever 242 is connected which is received in the sector-shaped operating hole 240 of block 228. The operating lever 242 is provided at its lower end with an eccentric shaft, namely a cam shaft 244 received in a cam groove (denoted by no reference numeral) formed at the rear end of adjusting rod 216. In the same manner as in the basic embodiment of FIG. 1 and 2, the operating lever 242 can rotate and move along the sector-shaped operating hole 240 to carry out rotating and camming operations causing the adjusting rod 216 to rotate and axially move. As the operating lever 242 moves along the sector-shaped operating hole 240, the adjusting rod 216 rotates to adjust the communication area of the axial communication adjusting groove 46 communicating with the communicating passages 32 and 33 of piston 200, in the same manner as shown in FIGS. 4 to 6. By this adjustment, it is possible to control the flow rate of operating medium flowing between operating medium chambers defined in the cylinder 204 at both sides of the piston 200, during the reciprocating movement of piston 200. On the other hand, the rotation of operating lever 242 causes the adjusting rod 216 to move forwardly or backwardly along the axial throughout holes 31 and 38 in the same manner as shown in FIGS. 8 to 10. By the forward movement of adjusting rod 216, the valve seat 39 comes into contact with the facing rear end surface of piston 200 and thus closes the rear ends of axial communicating passages 35. At this time, the valve seat 42 moves forwardly away from the facing front end surface of piston 200 and thus opens the front ends of axial communicating passages 35. On the other hand, the backward movement of adjusting rod 216 causes the valve seat 42 to come into contact with the facing front end surface of piston 200 and thus closes the front ends of axial communicating passages 35. At this time, the valve seat 39 moves backwardly away from the facing rear end surface of piston 200 and thus opens the rear ends of axial communicating passages 35.

Now, the operations of the above-mentioned construction will be described.

Where controls in operation load, operation speed and braking are required when the pistons 200 and 202 fixed to the block 228 by means of the piston rods 214 and 215 are pulled backwardly from the cylinders 204 and 206 fixed to the cylinder block 207, to move to their stretched positions, the operating lever 216 is first rotationally adjusted to be positioned at its front position shown in FIG. 8. At the front position, the adjusting rod 216 is maintained as having been forwardly moved along the axial throughout holes 31 and 38. At this time, the valve seat 39 is in contact with the facing rear end surface of piston 200 to close the rear ends of axial communicating passages 35, while the valve seat 42 is spaced apart from the facing front end surface of piston 200 to open the front ends of axial communicating passages 35.

As the pistons 200 and 202 are pulled relatively to the cylinders 204 and 206 under the above-mentioned condition, the internal operating medium contained in a rear operating medium chamber defined in the cylinder 204 at the rear side of piston 200 is forced to flow into a front operating medium chamber defined in the cylinder 204 at the front side of piston 200 via the radial communicating passage 33, the axial communication adjusting groove 46 and the radial communicating passage 32. Simultaneously, the internal operating medium contained in an operating medium chamber defined in the cylinder 206 is forced to flow into the rear operating medium chamber of cylinder 204 via the annular communicating passage 223, the communicating passage 208, the communication adjusting groove 210 and the annular communicating passage 222. The flow rate of the operating medium in the cylinder 204 can be adjusted by controlling the communication area of the axial communication adjusting groove 46 in the same manner as shown in FIGS. 4 to 6. This control can be achieved by rotating the adjusting rod 216 according to the movement of operating lever 242 along the sector-shaped operating hole 240. The flow rate of the operating medium flowing from the cylinder 206 to the cylinder 204 can be adjusted by controlling the communication area of the axial communication adjusting groove 210 in the same manner as shown in FIGS. 4 to 6. This control can be achieved by rotating the adjusting lever 212. By adjusting both the operating lever 242 and the adjusting lever 212, it is possible to achieve more precise and uniform controls of operation load, operation speed and braking.

On the other hand, when the pistons 200 and 202 are pushed forwardly into the cylinders 204 and 206 to return to their original retracted positions under the above-mentioned condition, the operating medium contained in the front operating medium chamber of cylinder 204 exerts a pressure in the axial communicating passages 35 and urge backwardly the valve seat 39 at the rear ends of axial communicating passages 35, against the force of compression spring 44, thereby causing the axial communicating passages 35 to be opened at their rear ends. Accordingly, the operating medium from the front operating medium chamber 27 can be allowed to flow through the opened axial communicating passages 35 into the rear operating medium chamber of cylinder 204. The operating medium is also allowed to flow into the rear operating medium chamber of cylinder 204 through the still opened radial communicating passage 32, axial communication adjusting groove 46 and radial communicating passage 33. However, the flow rate of operating medium in the latter case is very small and a main part of the operating medium flows into the rear operating medium chamber of cylinder 204 through the axial communicating passages 35. As a result, the flowing of operating medium can be easily carried out, so that the return of pistons 200 and 202 can be easily achieved with few load. Simultaneously with the flowing of operating medium in the cylinder 204, the operating medium contained in the rear operating medium chamber of cylinder 204 is forced to flow into the cylinder 206. The flow rate of operating medium flowing from the cylinder 204 to the cylinder 206 can be controlled by rotating properly the adjusting lever 212, so that controls of operation load, operation speed and braking can be partially achieved during the return operation.

Of course, when the communicating passage 208 is shut off by the adjustment of adjusting lever 212, a braking effect can be obtained during the reciprocating movements of pistons 200 and 202. Since the space defined in the cylinder 206 between the piston 202 and the end member 226 is maintained under atmosphere pressure, by virtue of the air communication port 224 provided at the end member 226, the reciprocating movements of piston 202 and thus piston 200 are carried out without any interference.

Where controls in operation load, operation speed and braking are required during when the pistons 200 and 202 are pushed forwardly into the cylinders 204 and 206 to return to their retracted positions, the axial communicating passages 35 are closed at their front ends to permit the operating medium in the front operating medium chamber of cylinder 204 to flow into the rear operating medium chamber of cylinder 204 through the radial communicating passage 32, axial communication adjusting groove 46 and radial communicating passage 33. The closing of axial communicating passages 35 is achieved by rotating the operating lever 242 from the position shown in FIG. 8 via the position shown in FIG. 9 to the position shown in FIG. 10 through an angle of 180°. That is, the rotation of operating lever 242 causes the adjusting rod 216 to move backwardly along the axial throughout holes 31 and 38, so that the valve seat 42 comes into contact with the facing front end surface of piston 200 and thus closes the front ends of axial communicating passages 35. At this time, the valve seat 39 is spaced apart from the facing rear end surface of piston 200. Under this condition, as the pistons 200 and 202 are pushed forwardly into the cylinders 204 and 206 to return to their retracted positions respectively, the operating medium in the front operating medium chamber of cylinder 204 flows into the rear operating medium chamber of cylinder 204 totally through the radial communicating passage 32, axial communication adjusting groove 46 and radial communicating passage 33. Simultaneously with the flowing of operating medium in the cylinder 204, the operating medium contained in the rear operating medium chamber of cylinder 204 flows into the cylinder 206, via the annular communicating passage 222, the communicating passage 208, the communication adjusting groove 210 and the annular communicating passage 223.

The flow rate of the operating medium in the cylinder 204 can be adjusted by controlling the communication area of the axial communication adjusting groove 46. This control can be achieved by rotating the adjusting rod 216 according to the movement of operating lever 242 along the sector-shaped operating hole 240. Simultaneously, the flow rate of operating medium flowing from the cylinder 204 to the cylinder 206 can be controlled by rotating properly the adjusting lever 212 and thus adjusting the communication area of the communication adjusting groove 210. By adjusting the operating lever 242 and the adjusting lever 212 simultaneously, therefore, it is possible to achieve more precise and uniform controls of operation load, operation speed and braking, during the compressing operation.

On the other hand, when the pistons 200 and 202 are pulled again from the cylinders 204 and 206 to move to their stretched positions under the condition that the axial communicating passages 35 are still closed at their front ends, the operating medium contained in the rear operating medium chamber of cylinder 204 exerts a pressure in the axial communicating passages 35 and urge forwardly the valve seat 42 at the front ends of axial communicating passages 35, against the force of compression spring 41, thereby causing the axial communicating passages 35 to be opened at their front ends. Accordingly, a main part of the operating medium from the rear operating medium chamber of cylinder 204 can be allowed to flow through the opened axial communicating passages 35 into the front operating medium chamber of cylinder 204, although a very small part of the operating medium passes through the radial communicating passage 33, axial communication adjusting groove 46 and radial communicating passage 32. As a result, the flowing of operating medium in the cylinder 204 can be easily carried out. Simultaneously with the flowing of operating medium in the cylinder 204, the operating medium contained in the cylinder 206 flows into the rear operating medium chamber of cylinder 204. By controlling the flow rate of operating medium flowing from the cylinder 206 to the cylinder 204 with a rotation of the adjusting lever 212, the controls of operation load, operation speed and braking can be partially achieved during the stretching operation.

Of course, when the communicating passage 208 is shut off by the adjustment of adjusting lever 212, a braking effect can be obtained during the stretching movements of pistons 200 and 202.

Figure 20:
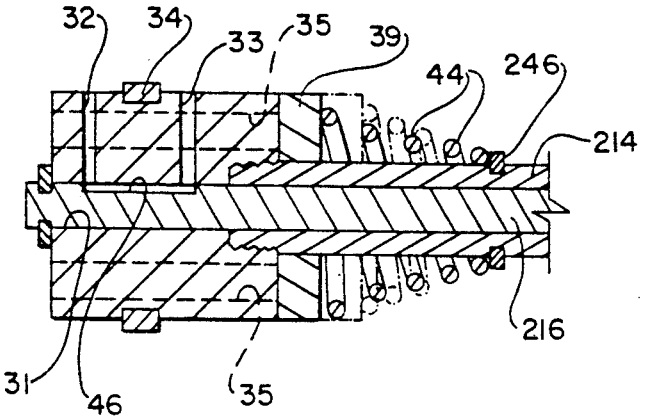
FIG. 20 is an enlarged sectional view of a control device with a construction modified from that of FIG. 17, in accordance with another embodiment of the present invention.
Figure 21:
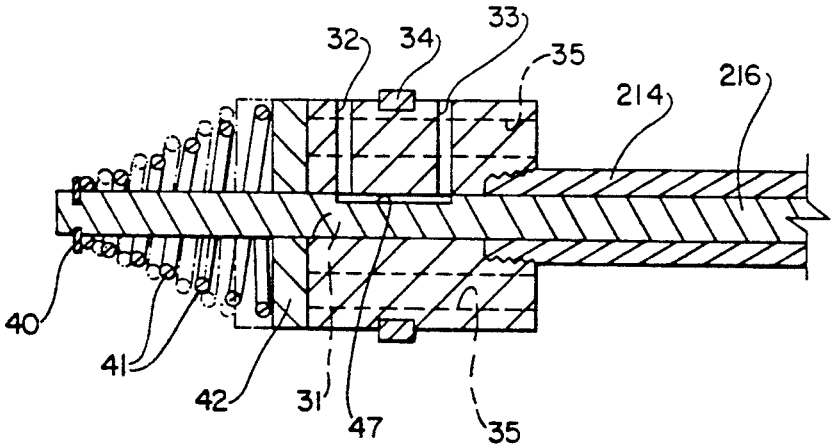
FIG. 21 is an enlarged sectional view of a control device with a construction modified from that of FIG. 17, in accordance with another embodiment of the present invention.

Referring to FIGS. 20 and 21, there are illustrated control devices with constructions modified from that of FIGS. 16 to 19, in accordance with other embodiments of the present invention. The device of FIG. 20 is exclusively used where controls of operation load, operation speed and braking are required when the pistons are pulled from the cylinders to move to their stretched positions. On the other hand, the device of FIG. 21 is exclusively used where controls of operation load, operation speed and braking are required when the pistons are pushed into the cylinders to move to their retracted positions.

The device of FIG. 20 has the same construction as that of FIGS. 16 to 19, except that it has no valve at the front side of piston. In the embodiment of FIG. 20, the device has, at the rear side of piston 200, a valve construction including a valve seat 39, a compression spring 44 and a snap ring 246. At normal state, the valve seat 39 is in contact with the rear surface of piston 200 by the urging force of compression spring 44 so that the communicating passages 35 are maintained at closed state. During the stretching operation, the operating medium in the cylinder 204 flows only through the radial communicating passage 33, axial communication adjusting groove 46 and radial communicating passage 32, resulting in achieving controls of operation load and operation speed. However, during the compressing operation, the operating medium in the communicating passages 35 urges the valve seat 39 to be spaced apart from the rear surface of piston 200, so that it can flow through the communicating passages 35, with few load. Thus, the device of this embodiment is suitable for an exclusive use in the stretching operation.

The device of FIG. 21 has the same construction as that of FIGS. 16 to 19, except that it has no valve at the rear side of piston. In the embodiment of FIG. 21, the device has, at the front side of piston 200, a valve construction including a snap ring 40, a compression spring 41 and a valve seat 42. At normal state, the valve seat 42 is in contact with the front surface of piston 200 by the urging force of compression spring 41 so that the communicating passages 35 are maintained at closed state. During the compressing operation, the operating medium in the cylinder 204 flows only through the radial communicating passage 32, axial communication adjusting groove 46 and radial communicating passage 33, resulting in achieving controls of operation load and operation speed. However, during the stretching operation, the operating medium in the communicating passages 35 urges the valve seat 42 to be spaced apart from the front surface of piston 200, so that it can flow through the communicating passages 35, with few load. Thus, the device of this embodiment is suitable for an exclusive use in the compressing operation.

Detailed operations of the devices shown in FIGS. 20 and 21 can be readily recognized by referring to the above description made in conjunction with the embodiment of FIGS. 16 to 19 and thus their descriptions are omitted herein.

Figure 22:
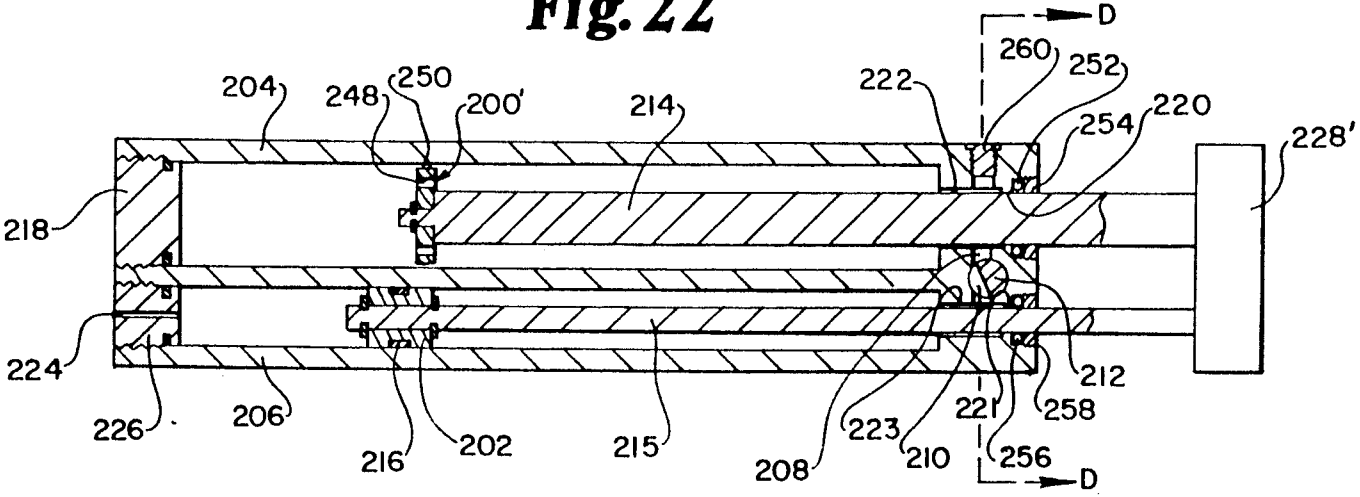
FIG. 22 is a sectional view of a control device with a construction modified from that of FIG. 16, in accordance with another embodiment of the present invention.
Figure 23:
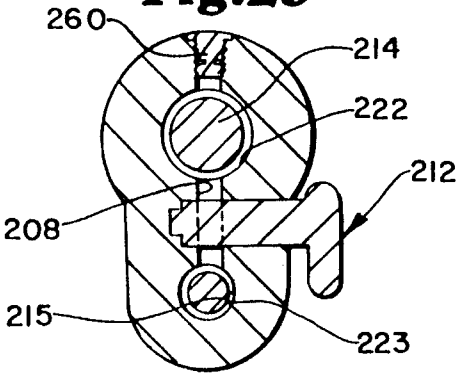
FIG. 23 is a cross-sectional view taken along the line D—D of FIG. 22.

FIGS. 22 and 23 illustrate a control device with a simple inner construction modified from that of FIGS. 16 to 19, in accordance with other embodiments of the present invention. The elements of FIGS. 22 and 23 identical or similar to those of FIGS. 16 to 19 are denoted by the same reference numeral as used in FIGS. 16 to 19.

As shown in FIGS. 22 and 23, the control device is of a double cylinder construction which comprises a pair of cylinders 204 and 206 disposed axially in parallel to each other, in similar to that of FIGS. 16 to 19.

Within the cylinders 204 and 206, pistons 200' and 202 are slidably disposed. Although the piston 202 has the same construction as that of FIGS. 16 to 19, the piston 200' has a simple construction only including a plurality of axial communicating passages 248 serving to allow the flowing of operating medium in the cylinder 200' with few resistance, differently from that of FIGS. 16 to 19. Around circumferential surfaces of pistons 200' and 202, seal rings 250 and 216 are fitted, respectively.

The cylinders 204 and 206 have a common rear end integrally formed with the cylinders 204 and 206 and opened front ends, respectively. The front ends of cylinders 204 and 206 are closed by end members 218 and 226 which have the same constructions as those of the embodiment of FIGS. 16 to 19, respectively. Piston rods 214 and 215 extend backwardly through the cylinder rear end and fixedly coupled at their rear ends to a block 228'. At the cylinder rear end, a communication construction is provided which includes an annular communicating passage 222, a communicating passage 208, a communication adjusting groove 210 and an annular communicating passage 223, all having the same constructions as those of FIGS. 16 to 19. As in the embodiment of FIGS. 16 to 19, an adjusting lever 212 is provided which adjusts the communication area of the communication adjusting groove 210. At the rear end, the cylinders 204 and 206 have throughout holes 220 and 221 through which the piston rods 214 and 215 extend backwardly, respectively. To the rear ends of throughout holes 220 and 221, seal rings 252 and 256 and end members 254 and 258 are fitted for providing seal effects at the throughout holes 220 and 221. The block 228' is adapted only to fix the piston rods 214 and 215, differently from the block 228 of the embodiment of FIGS. 16 to 19.

In FIGS. 22 and 23, the reference numeral 260 denotes an end member for closing an opening which has been formed upon forming the communicating passage 208 in the cylinder rear end.

When the pistons 200' and 202 are pushed forwardly into the cylinders 204 and 206 to move to their retracted positions respectively, the operating medium contained in the cylinder 204 flows into the cylinder 206 through the annular communicating passage 222, the communicating passage 208, the communication adjusting groove 210 and the annular communicating passage 223. On the other hand, when the pistons 200' and 202 are pulled backwardly from the cylinders 204 and 206 to move to their stretched positions respectively, the operating medium contained in the cylinder 206 flows into the cylinder 204 through the annular communicating passage 223, the communication adjusting groove 210, the communicating passage 208, and the annular communicating passage 222. During the compressing operation, air in a space defined between the piston 202 and the end member 226 is vented to external through the air communication port 224 provided at the end member 226. During the stretching operation, external air enters the space through the air communication port 224.

During these compressing and stretching operations, the flow rate of operating medium flowing between the cylinders 204 and 206 can be controlled by adjusting the adjusting lever 212. For example, when the adjusting lever 212 is adjusted to align the communication adjusting groove 210 with the communicating passage 208, the control device is maintained at a maximum operation speed and minimum load state. At a state that the communicating passage 208 is closed by the fact that the communication adjusting groove 210 has no portion aligning with the communicating passage 208, the control device is maintained at braking state preventing compressing and stretching operations. When the communicating passage 208 is partially opened by the fact that the communication adjusting groove 210 has a portion aligning with the communicating passage 208, controls of operation speed and load can be properly achieved according to the degree of the alignment between the communicating passage 208 and the communication adjusting groove 210, during the compressing and stretching operations.

As apparent from the above description, the present invention provides a device for controlling a pneumatic cylinder device, which is of a double cylinder construction comprising an outer cylinder and an inner cylinder sealably fitted in the outer cylinder to slide along the outer cylinder. In the inner cylinder, a piston with a valve at one side thereof or valves at both sides thereof is slidably disposed. To control the valve or valves, an adjusting rod is provided which is slidably and rotatably disposed in the piston and its piston rod and adjusted by an operating lever. The present invention also provides another control device of a double cylinder construction which comprises a pair of cylinders disposed axially in parallel to each other. In the cylinders, pistons are disposed respectively, one of which has a valve at one side thereof or valves at both sides thereof. The cylinders are communicated with each other by a communication construction having a communication adjusting groove and an adjusting lever for adjusting the communication area of communication adjusting groove.

In either case, controls of operation load, operation speed and braking are easily achieved during the compressing and stretching operations without requiring a separate device for supplying a separate operating medium from external to the cylinder or discharging the operating medium form the cylinder to external, by controlling the valve or valves and/or the communication adjusting groove. With these constructions, the devices of the present invention by themselves can be applied to appliances requiring a control of load. Where they are incorporated in pneumatic cylinder devices, it is possible to achieve more precise and uniform controls of operation load, operation speed and braking.

Since the controls are mechanically achieved in accordance with the present invention, improvements in durability is obtained. Furthermore, the overall construction is simplified to make the manufacture easy and economical.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A device for controlling a pneumatic cylinder device comprising:

an outer cylinder having an opened front end and an opened rear end;

a cylinder block coupled to said rear end of the outer cylinder to close it, said cylinder block having an axial hole and a sector-shaped radial hole communicating with said axial hole;

an inner cylinder sealably fitted in the outer cylinder to slide axially in the outer cylinder, said inner cylinder having a closed front end protruded forwardly from said front end of the outer cylinder and a rear end disposed in the outer cylinder and provided with a central throughout hole;

seal means adapted to provide a seal at the opened front end of the outer cylinder;

a piston sealably fitted in the inner cylinder to slide axially in the inner cylinder and dividing the interior of the inner cylinder into a front operating medium chamber and a rear operating medium chamber, said piston having a front end, a rear end and a central throughout hole;

a hollow piston rod having a front end coupled to said rear end of the piston, a rear end coupled to said cylinder block, and a throughout hole;

a plurality of axial communicating passages extending axially throughout the piston to permit an operating medium in the inner cylinder to flow freely between said front and rear operating medium chambers with each other, each of said axial communicating passages having a front end opened to the front operating medium chamber and a rear end opened to the rear operating medium;

valve means adapted to open and close said axial communicating passages; and control means adapted to control a flow rate of the operating medium flowing between the front and rear operating medium chambers, said control means including, an adjusting rod axially extending through said throughout hole of the piston and said throughout hole of the piston rod to slide forwardly and backwardly and rotate, said adjusting rod having a front end extending forwardly beyond the front end of the piston and a rear end extending backwardly beyond the rear end of the piston rod and disposed in the axial hole of the cylinder block;

a pair of axially spaced radial communicating passages extending from an outer circumferential surface of the piston to the central throughout hole of the piston;

a communication adjusting groove formed axially at a circumferential surface of a portion of the adjusting rod axially extending between said radial communicating passages, said groove serving to communicate the radial communicating passages with each other selectively according to a rotation of the adjusting rod, but irrespective of the forward and backward sliding movements of the adjusting rod; and an operating lever, said operating lever being operably located and movable to make the adjusting rod rotate.

2. A device for controlling a pneumatic cylinder device comprising:

a cylinder having an opened front end and an opened rear end;

a front end member coupled to said front end of the cylinder and provided with an air communication port;

a rear end member coupled to said rear end of the cylinder and provided with an axial throughout hole;

a piston sealably fitted in the cylinder to slide axially in the cylinder and defining together with said rear end member a rear operating medium chamber in the interior of the cylinder, said piston having a front end, a rear end and a central throughout hole;

a reciprocating block sealably fitted in the cylinder between the front end member and the piston and defining together with the piston a front operating medium chamber in the interior of the cylinder;

a compression spring disposed in the cylinder between the front end member and said reciprocating block and adapted to urge the reciprocating block backwardly;

a hollow piston rod extending through said axial throughout hole of the rear end member and having a front end coupled to said rear end of the piston, a rear end extending backwardly beyond the rear end member, and a throughout hole;

an adjusting block coupled to said rear end of the piston rod and provided with an axial hole and a sector-shaped radial hole communicating with said axial hole;

a plurality of axial communicating passages extending axially throughout the piston to permit an operating medium in the cylinder to flow freely between said front and rear operating medium chambers with each other, each of said axial communicating passages having a front end opened to the front operating medium chamber and a rear end opened to the rear operating medium;

valve means adapted to open and close said axial communicating passages, said valve means comprising:

a valve mounted to said front end of the piston rod in the rear operating medium chamber and adapted to open and close the axial communicating passages, said valve comprising a valve seat slidably fitted around the front end of the piston rod and adapted to come into contact with the rear ends of the axial communicating passages and a rear compression spring adapted to always urge said rear valve seat forwardly, for closing the axial communicating passages, but allow the rear valve seat to move backwardly when a pressure of the operating medium is exerted on the rear valve seat at the rear ends of the axial communicating passages, in a backward direction, for opening the axial communicating passages; and control means adapted to control a flow rate of the operating medium flowing between the front and rear operating medium chambers, said control means comprising:

an adjusting rod axially extending through said throughout hole of the piston and said throughout hole of the piston rod to rotate, said adjusting rod having a rear end extending backwardly beyond the rear end of the piston rod and disposed in the axial hole of the adjusting block;

a pair of axially spaced radial communicating passages extending from an outer circumferential surface of the piston to the central throughout hole of the piston;

a communication adjusting groove formed axially at a circumferential surface of a portion of the adjusting rod axially extending between said radial communicating passages, said groove serving to communicate the radial communicating passages with each other selectively according to a rotation of the adjusting rod; and an operating lever inserted in said sector-shaped radial hole of the adjusting block and coupled to said rear end of the adjusting rod disposed in the axial hole of the adjusting block, said operating lever being movable along the sector-shaped radial hole to make the adjusting rod rotate.

3. A device for controlling a pneumatic cylinder device comprising:

a first cylinder having an opened front end and an opened rear end;

a second cylinder disposed in parallel to said first cylinder and having an opened front end and an opened rear end;

a first front end member coupled to said front end of the first cylinder to close it;

a second front end member coupled to said front end of the second cylinder and provided with an air communication port;

a cylinder block coupled to said rear ends of the first and second cylinders and provided with a first axial throughout hole and a second axial throughout hole;

a first piston sealably fitted in the first cylinder to slide axially in the first cylinder and dividing the interior of the first cylinder into a front operating medium chamber and a rear operating medium chamber, said piston having a front end, a rear end and a central throughout hole;

a first piston rod having a front end coupled to said rear end of the first piston, a rear end extending backwardly beyond the cylinder block, and a throughout hole;

a second piston sealably fitted in the second cylinder to slide axially in the second cylinder and defining together with the cylinder block an operating medium chamber in the interior of the cylinder;

a second piston rod having a front end coupled to the second piston, a rear end extending backwardly beyond the cylinder block;

a communicating passage provided in the cylinder block and adapted to communicate said rear operating medium chamber of the first cylinder and said operating medium chamber of the second cylinder;

an adjusting lever adapted to adjust a flow rate of the operating medium passing through said communicating passage;

a plurality of axial communicating passages extending axially throughout the piston to permit an operating medium in the first cylinder to flow freely between said front and rear operating medium chambers with each other, each of said axial communicating passages having a front end opened to the front operating medium chamber and a rear end opened to the rear operating medium;

an adjusting block coupled to said rear ends of the first and second piston rods so as to make the first and second pistons move integrally with each other, said adjusting block having an axial hole and a sector-shaped radial hole communicating with said axial hole;

valve means adapted to open and close said axial communicating passages; and control means adapted to control a flow rate of the operating medium flowing between the front and rear operating medium chambers of the first cylinder, said control means including, an adjusting rod axially extending through said throughout hole of the first piston and said throughout hole of the first piston rod to slide forwardly and backwardly and rotate, said adjusting rod having a front end extending forwardly beyond the front end of the first piston and a rear end extending backwardly beyond the rear end of the first piston rod and disposed in the axial hole of the adjusting block;

a pair of axially spaced radial communicating passages extending from an outer circumferential surface of the first piston to the central throughout hole of the first piston;

a communication adjusting groove formed axially at a circumferential surface of a portion of the adjusting rod axially extending between said radial communicating passages, said groove serving to communicate the radial communicating passages with each other selectively according to a rotation of the adjusting rod, but irrespective of the forward and backward sliding movements of the adjusting rod; and an operating lever, said operating lever being operably located and movable to make the adjusting rod rotate.

4. A device for controlling a pneumatic cylinder device comprising:

an outer cylinder having an opened front end and an opened rear end;

a cylinder block coupled to said rear end of the outer cylinder to close it, said cylinder block having an axial hole and a sector-shaped radial hole communicating with said axial hole;

an inner cylinder sealably fitted in the outer cylinder to slide axially in the outer cylinder, said inner cylinder having a closed front end protruded forwardly from said front end of the outer cylinder and a rear end disposed in the outer cylinder and provided with a central throughout hole;

seal means adapted to provide a seal at the opened front end of the outer cylinder;

a piston sealably fitted in the inner cylinder to slide axially in the inner cylinder and dividing the interior of the inner cylinder into a front operating medium chamber and a rear operating medium chamber, said piston having a front end, a rear end and a central throughout hole;

a hollow piston rod having a front end coupled to said rear end of the piston, a rear end coupled to said cylinder block, and a throughout hole;

a plurality of axial communicating passages extending axially throughout the piston to permit an operating medium in the inner cylinder to flow freely between said front and rear operating medium chambers with each other, each of said axial communicating passages having a front end opened to the front operating medium chamber and a rear end opened to the rear operating medium;

valve means adapted to open and close said axial communicating passages, said valve means including, an adjusting rod axially extending through said throughout hole of the piston and said throughout hole of the piston rod to slide forwardly and backwardly and rotate, said adjusting rod having a front end extending forwardly beyond the front end of the piston and a rear end extending backwardly beyond the rear end of the piston rod and disposed in the axial hole of the cylinder block;

a valve receiving chamber formed at the rear end of the piston and communicating with the rear ends of the axial communicating passages and the rear operating medium chamber;

a front valve mounted to the front end of the adjusting rod in the front operating medium chamber and adapted to open and close the front ends of the axial communicating passages according to the forward and backward sliding movements of the adjusting rod, said front valve comprising a front valve seat slidably fitted around the front end of the adjusting rod and adapted to come into contact with the front ends of the axial communicating passages upon the backward sliding movement of the adjusting rod and a front compression spring adapted to always urge said front valve seat backwardly, but allow the front valve seat to move forwardly when a pressure of the operating medium is exerted on the front valve seat at the front ends of the axial communicating passages, in a forward direction;

a rear valve mounted to a portion of the adjusting rod in said valve receiving chamber and adapted to close and open the rear ends of the axial communicating passages according to the forward and backward sliding movements of the adjusting rod, said rear valve comprising a rear valve seat slidably fitted around said portion of the adjusting rod disposed in the valve receiving chamber and adapted to come into contact with the rear ends of the axial communicating passages upon the forward sliding movement of the adjusting rod and a rear compression spring adapted to always urge said rear valve seat forwardly, but allow the rear valve seat to move backwardly when a pressure of the operating medium is exerted on the rear valve seat at the rear ends of the axial communicating passages, in a backward direction; and an operating lever inserted in said sector-shaped radial hole of the cylinder block and coupled to said rear end of the adjusting rod disposed in the axial hole of the cylinder block, said operating lever being rotatable to make the adjusting rod slide forwardly and backwardly; and control means adapted to control a flow rate of the operating medium flowing between the front and rear operating medium chambers said control means including, a pair of axially spaced radial communicating passages extending from an outer circumferential surface of the piston to the central throughout hole of the piston;

a communication adjusting groove formed axially at a circumferential surface of a portion of the adjusting rod axially extending between said radial communicating passages, said groove serving to communicate the radial communicating passages with each other selectively according to a rotation of the adjusting rod, but irrespective of the forward and backward sliding movements of the adjusting rod; and said operating lever being movable along the sector-shaped radial hole to make the adjusting rod rotate.

5. A device for controlling a pneumatic cylinder device comprising:

an outer cylinder having an opened front end and an opened rear end;

a cylinder block coupled to said rear end of the outer cylinder to close it, said cylinder block having an axial hole and a sector-shaped radial hole communicating with said axial hole;

an inner cylinder sealably fitted in the outer cylinder to slide axially in the outer cylinder, said inner cylinder having a closed front end protruded forwardly from said front end of the outer cylinder and a rear end disposed in the outer cylinder and provided with a central throughout hole;

seal means adapted to provide a seal at the opened front end of the outer cylinder;

a piston sealably fitted in the inner cylinder to slide axially in the inner cylinder and dividing the interior of the inner cylinder into a front operating medium chamber and a rear operating medium chamber, said piston having a front end, a rear end and a central throughout hole;

a hollow piston rod having a front end coupled to said rear end of the piston, a rear end coupled to said cylinder block, and a throughout hole;

a plurality of axial communicating passages extending axially throughout the piston to permit an operating medium in the inner cylinder to flow freely between said front and rear operating medium chambers with each other, each of said axial communicating passages having a front end opened to the front operating medium chamber and a rear end opened to the rear operating medium;

valve means adapted to open and close said axial communicating passages, said valve means including, an adjusting rod axially extending through said throughout hole of the piston and said throughout hole of the piston rod to slide forwardly and backwardly and rotate, said adjusting rod having a front end extending forwardly beyond the front end of the piston and a rear end extending backwardly beyond the rear end of the piston rod and disposed in the axial hole of the cylinder block;

a valve mounted to the front end of the adjusting rod in the front operating medium chamber and adapted to open and close the axial communicating passages according to the forward and backward sliding movements of the adjusting rod, said valve comprising a valve seat slidably fitted around the front end of the adjusting rod and adapted to come into contact with the front ends of the axial communicating passages upon the backward sliding movement of the adjusting rod, for closing the axial communicating passages, and a compression spring adapted to always urge said valve seat backwardly, but allow the valve seat to move forwardly when a pressure of the operating medium is exerted on the valve seat at the front ends of the axial communicating passages, in a forward direction, for opening the axial communicating passages;

an operating lever inserted in said sector-shaped radial hole of the cylinder block and coupled to said rear end of the adjusting rod disposed in the axial hole of the cylinder block, said operating lever being rotatable to make the adjusting rod slide forwardly and backwardly; and control means adapted to control a flow rate of the operating medium flowing between the front and rear operating medium chambers, said control means including, a pair of axially spaced radial communicating passages extending from an outer circumferential surface of the piston to the central throughout hole of the piston;

a communication adjusting groove formed axially at a circumferential surface of a portion of the adjusting rod axially extending between said radial communicating passages, said groove serving to communicate the radial communicating passages with each other selectively according to a rotation of the adjusting rod, but irrespective of the forward and backward sliding movements of the adjusting rod; and said operating lever being movable along the sector-shaped radial hole to make the adjusting rod rotate.

6. A device for controlling a pneumatic cylinder device comprising:

an outer cylinder having an opened front end and an opened rear end;

a cylinder block coupled to said rear end of the outer cylinder to close it, said cylinder block having an axial hole and a sector-shaped radial hole communicating with said axial hole;

an inner cylinder sealably fitted in the outer cylinder to slide axially in the outer cylinder, said inner cylinder having a closed front end protruded forwardly from said front end of the outer cylinder and a rear end disposed in the outer cylinder and provided with a central throughout hole;

seal means adapted to provide a seal at the opened front end of the outer cylinder;

a piston sealably fitted in the inner cylinder to slide axially in the inner cylinder and dividing the interior of the inner cylinder into a front operating medium chamber and a rear operating medium chamber, said piston having a front end, a rear end and a central throughout hole;

a hollow piston rod having a front end coupled to said rear end of the piston, a rear end coupled to said cylinder block, and a throughout hole;

a plurality of axial communicating passages extending axially throughout the piston to permit an operating medium in the inner cylinder to flow freely between said front and rear operating medium chambers with each other, each of said axial communicating passages having a front end opened to the front operating medium chamber and a rear end opened to the rear operating medium;

valve means adapted to open and close said axial communicating passages, said valve means including, a valve mounted to said front end of the piston rod in the rear operating medium chamber and adapted to open and close the axial communicating passages, said valve comprising a valve seat slidably fitted around the front end of the piston rod and adapted to come into contact with the rear ends of the axial communicating passages and a rear compression spring adapted to always urge said rear valve seat forwardly, for closing the axial communicating passages, but allow the rear valve seat to move backwardly when a pressure of the operating medium is exerted on the rear valve seat at the rear ends of the axial communicating passages, in a backward direction, for opening the axially communicating passages; and control means adapted to control a flow rate of the operating medium flowing between the front and rear operating medium chambers, said control means including, an adjusting rod axially extending through said throughout hole of the piston and said throughout hole of the piston rod to rotate, said adjusting rod having a rear end extending backwardly beyond the rear end of the piston rod and disposed in the axial hole of the cylinder block;

a pair of axially spaced radial communicating passages extending from an outer circumferential surface of the piston to the central throughout hole of the piston;

a communication adjusting groove formed axially at a circumferential surface of a portion of the adjusting rod axially extending between said radial communicating passages, said groove serving to communicate the radial communicating passages with each other selectively according to a rotation of the adjusting rod; and an operating lever inserted in said sector-shaped radial hole of the cylinder block and coupled to said rear end of the adjusting rod disposed in the axial hole of the cylinder block, said operating level being movable along the sector-shaped radial hole to make the adjusting rod rotate.

7. A device for controlling a pneumatic cylinder device comprising:

an outer cylinder having an opened front end and an opened rear end;

a cylinder block coupled to said rear end of the outer cylinder to close it, said cylinder block having an axial hole and a sector-shaped radial hole communicating with said axial hole;

an inner cylinder sealably fitted in the outer cylinder to slide axially in the outer cylinder, said inner cylinder having a closed front end protruded forwardly from said front end of the outer cylinder and a rear end disposed in the outer cylinder and provided with a central throughout hole;

seal means adapted to provide a seal at the opened front end of the outer cylinder, said seal means including, an outer threaded taper portion formed on said front end of the outer cylinder;

an annular seal member threadedly coupled to the front end of outer cylinder around an outer circumferential surface of the inner cylinder, said annular seal member having an inner threaded taper portion adapted to be threadedly coupled to said outer threaded taper portion, a first annular groove and a second annular groove connected to said first annular groove;

a seal ring fitted in the first and second annular grooves of the annular seal member, said seal ring having a front end portion pressing fitted in the second annular groove of the annular seal member, a rear end portion pressing fitted in the first annular groove of the annular seal member, a dust rip extending radially from the front end portion and being in pressing contact with the outer circumferential surface of the inner cylinder, an oil rip extending radially between said rear end portion and the front end portion and being in pressing contact with the outer circumferential surface of the inner cylinder, and a pair of recesses defined between said dust rip and said oil rip and between the oil rip and the rear end portion, respectively;

a piston sealably fitted in the inner cylinder to slide axially in the inner cylinder and dividing the interior of the inner cylinder into a front operating medium chamber and a rear operating medium chamber, said piston having a front end, a rear end and a central throughout hole;

a hollow piston rod having a front end coupled to said rear end of the piston, a rear end coupled to said cylinder block, and a throughout hole;

a plurality of axial communicating passages extending axially throughout the piston to permit an operating medium in the inner cylinder to flow freely between said front and rear operating medium chambers with each other, each of said axial communicating passages having a front end opened to the front operating medium chamber and a rear end opened to the rear operating medium;

valve means adapted to open and close said axial communicating passages; and control means adapted to control a flow rate of the operating medium flowing between the front and rear operating medium chambers.

8. A device for controlling a pneumatic cylinder device comprising:

a first cylinder having an opened front end and an opened rear end;

a second cylinder disposed in parallel to said first cylinder and having an opened front end and an opened rear end;

a first front end member coupled to said front end of the first cylinder to close it;

a second front end member coupled to said front end of the second cylinder and provided with an air communication port;

a cylinder block coupled to said rear ends of the first and second cylinders and provided with a first axial throughout hole and a second axial throughout hole;

a first piston sealably fitted in the first cylinder to slide axially in the first cylinder and dividing the interior of the first cylinder into a front operating medium chamber and a rear operating medium chamber, said piston having a front end, a rear end and a central throughout hole;

a first piston rod having a front end coupled to said rear end of the first piston, a rear end extending backwardly beyond the cylinder block, and a throughout hole;

a second piston sealably fitted in the second cylinder to slide axially in the second cylinder and defining together with the cylinder block an operating medium chamber in the interior of the cylinder;

a second piston rod having a front end coupled to the second piston, a rear end extending backwardly beyond the cylinder block;

a communicating passage provided in the cylinder block and adapted to communicate said rear operating medium chamber of the first cylinder and said operating medium chamber of the second cylinder;

an adjusting lever adapted to adjust a flow rate of the operating medium passing through said communicating passage;

a plurality of axial communicating passages extending axially throughout the piston to permit an operating medium in the first cylinder to flow freely between said front and rear operating medium chambers with each other, each of said axial communicating passages having a front end opened to the front operating medium chamber and a rear end opened to the rear operating medium;

an adjusting block coupled to said rear ends of the first and second piston rods so as to make the first and second pistons move integrally with each other, said adjusting block having an axial hole and a sector-shaped radial hole communicating with said axial hole;

valve means adapted to open and close said axial communicating passages, said valve means including, an adjusting rod axially extending through said throughout hole of the first piston and said throughout hole of the first piston rod to slide forwardly and backwardly and rotate, said adjusting rod having a front end extending forwardly beyond the front end of the first piston and a rear end extending backwardly beyond the rear end of the first piston rod and disposed in the axial hole of the adjusting block;

a pair of radially aligned holes provided at the front end of the piston rod and opened to the throughout hole of the piston rod, said radial holes having a predetermined axial length not less than a sliding distance of the adjusting rod and a predetermined peripheral length not less than a peripheral length corresponding to a rotating angle of the adjusting rod;

a front valve mounted to the front end of the adjusting rod in the front operating medium chamber of the first cylinder and adapted to open and close the front ends of the axial communicating passages according to the forward and backward sliding movements of the adjusting rod, said front valve comprising a front valve seat slidably fitted around the front end of the adjusting rod and adapted to come into contact with the front ends of the axial communicating passages upon the backward sliding movement of the adjusting rod and a front compression spring adapted to always urge said front valve seat backwardly, but allow the front valve seat to move forwardly when a pressure of the operating medium is exerted on the front valve seat at the front ends of the axial communicating passages, in a forward direction;

a rear valve mounted to a portion of the adjusting rod in said rear operating medium chamber of the first cylinder and adapted to close and open the rear ends of the axial communicating passages according to the forward and backward sliding movements of the adjusting rod, said rear valve comprising a protruding pin fixed to the adjusting rod and protruded through the radial holes of the first piston rod, a sliding member slidably fitted around the front end of the first piston rod and fixed to said protruding pin, said sliding member having at its front end with an engaging portion, a rear valve seat slidably fitted around the sliding member and adapted to come into contact with the rear ends of the axial communicating passages upon the forward sliding movement of the adjusting rod, said rear valve seat having at its rear end with an engaging portion engagable with said engaging portion of the sliding member and a rear compression spring adapted to always urge said rear valve seat forwardly, but allow the rear valve seat to move backwardly when a pressure of the operating medium is exerted on the rear valve seat at the rear ends of the axial communicating passages, in a backward direction; and an operating lever inserted in said sector-shaped radial hole of the adjusting block and coupled to said rear end of the adjusting rod disposed in the axial hole of the adjusting block, said operating lever being rotatable to make the adjusting rod slide forwardly and backwardly; and control means adapted to control a flow rate of the operating medium flowing between the front and rear operating medium chambers of the first cylinder, said control means including, a pair of axially spaced radial communicating passages extending from an outer circumferential surface of the first piston to the central throughout hole of the first piston;

a communication adjusting groove formed axially at a circumferential surface of a portion of the adjusting rod axially extending between said radial communicating passages, said groove serving to communicate the radial communicating passages with each other selectively according to a rotation of the adjusting rod, but irrespective of the forward and backward sliding movements of the adjusting rod; and said operating lever being movable along the sector-shaped radial hole of the adjusting block to make the adjusting rod rotate.

9. A device for controlling a pneumatic cylinder device comprising:

a first cylinder having an opened front end and an opened rear end;

a second cylinder disposed in parallel to said first cylinder and having an opened front end and an opened rear end;

a first front end member coupled to said front end of the first cylinder to close it;

a second front end member coupled to said front end of the second cylinder and provided with an air communication port;

a cylinder block coupled to said rear ends of the first and second cylinders and provided with a first axial throughout hole and a second axial throughout hole;

a first piston sealably fitted in the first cylinder to slide axially in the first cylinder and dividing the interior of the first cylinder into a front operating medium chamber and a rear operating medium chamber, said piston having a front end, a rear end and a central throughout hole;

a first piston rod having a front end coupled to said rear end of the first piston, a rear end extending backwardly beyond the cylinder block, and a throughout hole;

a second piston sealably fitted in the second cylinder to slide axially in the second cylinder and defining together with the cylinder block an operating medium chamber in the interior of the cylinder;

a second piston rod having a front end coupled to the second piston, a rear end extending backwardly beyond the cylinder block;

a communicating passage provided in the cylinder block and adapted to communicate said rear operating medium chamber of the first cylinder and said operating medium chamber of the second cylinder;

an adjusting lever adapted to adjust a flow rate of the operating medium passing through said communicating passage;

a plurality of axial communicating passages extending axially throughout the piston to permit an operating medium in the first cylinder to flow freely between said front and rear operating medium chambers with each other, each of said axial communicating passages having a front end opened to the front operating medium chamber and a rear end opened to the rear operating medium;

an adjusting block coupled to said rear ends of the first and second piston rods so as to make the first and second pistons move integrally with each other, said adjusting block having an axial hole and a sector-shaped radial hole communicating with said axial hole;

valve means adapted to open and close said axial communicating passages, said valve means including, a valve mounted to said front end of the first piston rod in the rear operating medium chamber of the first cylinder and adapted to open and close the axial communicating passages of the first piston, said valve comprising a valve seat slidably fitted around the front end of the first piston rod and adapted to come into contact with the rear ends of the axial communicating passages and a rear compression spring adapted to always urge said rear valve seat forwardly, for closing the axial communicating passages, but allow the rear valve seat to move backwardly when a pressure of the operating medium is exerted on the rear valve seat at the rear ends of the axial communicating passages, in a backward direction, for opening the axial communicating passages; and control means adapted to control a flow rate of the operating medium flowing between the front and rear operating medium chambers of the first cylinder, said control means including, an adjusting rod axially extending throughout said throughout hole of the first piston and said throughout hole of the first piston rod to rotate, said adjusting rod having a rear end extending backwardly beyond the rear end of the piston rod and disposed in the axial hole of the adjusting block;

a pair of axially spaced radial communicating passages extending from an outer circumferential surface of the first piston to the central throughout hole of the first piston;

a communication adjusting groove formed axially at a circumferential surface of a portion of the adjusting rod axially extending between said radial communicating passages, said groove serving to communicate the radial communicating passages with each other selectively according to a rotation of the adjusting rod; and an operating lever inserted in said sector-shaped radial hole of the adjusting block and coupled to said rear end of the adjusting rod disposed in the axial hole of the adjusting block, said operating lever being movable along the sector-shaped radial hole to make the adjusting rod rotate.

10. A device for controlling a pneumatic cylinder device comprising:

a first cylinder having an opened front end and an opened rear end;

a second cylinder disposed in parallel to said first cylinder and having an opened front end and an opened rear end;

a first front end member coupled to said front end of the first cylinder to close it;

a second front end member coupled to said front end of the second cylinder and provided with an air communication port;

a cylinder block coupled to said rear ends of the first and second cylinders and provided with a first axial throughout hole and a second axial throughout hole;

a first piston sealably fitted in the first cylinder to slide axially in the first cylinder and dividing the interior of the first cylinder into a front operating medium chamber and a rear operating medium chamber, said piston having a front end, a rear end and a central throughout hole;

a first piston rod having a front end coupled to said rear end of the first piston, a rear end extending backwardly beyond the cylinder block, and a throughout hole;

a second piston sealably fitted in the second cylinder to slide axially in the second cylinder and defining together with the cylinder block an operating medium chamber in the interior of the cylinder;

a second piston rod having a front end coupled to the second piston, a rear end extending backwardly beyond the cylinder block;

a communicating passage provided in the cylinder block and adapted to communicate said rear operating medium chamber of the first cylinder and said operating medium chamber of the second cylinder;

an adjusting lever adapted to adjust a flow rate of the operating medium passing through said communicating passage;

a plurality of axial communicating passages extending axially throughout the piston to permit an operating medium in the first cylinder to flow freely between said front and rear operating medium chambers with each other, each of said axial communicating passages having a front end opened to the front operating medium chamber and a rear end opened to the rear operating medium;

an adjusting block coupled to said rear ends of the first and second piston rods so as to make the first and second pistons move integrally with each other, said adjusting block having an axial hole and a sector-shaped radial hole communicating with said axial hole;

valve means adapted to open and close said axial communicating passages, said valve means including, an adjusting rod axially extending throughout said throughout hole of the first piston and said throughout hole of the first piston rod to slide forwardly and backwardly and rotate, said adjusting rod having a front end extending forwardly beyond the front end of the first piston and a rear end extending backwardly beyond the rear end of the first piston rod and disposed in the axial hole of the adjusting block;

a valve mounted to the front end of the adjusting rod in the front operating medium chamber of the first cylinder and adapted to open and close the axial communicating passages of the first piston according to the forward and backward sliding movements of the adjusting rod, said valve comprising a valve seat slidably fitted around the front end of the adjusting rod and adapted to come into contact with the front ends of the axial communicating passages upon the backward sliding movement of the adjusting rod, for closing the axial communicating passages, and a compression spring adapted to always urge said valve seat backwardly, but allow the valve seat to move forwardly when a pressure of the operating medium is exerted on the valve seat at the front ends of the axial communicating passages, in a forward direction, for opening the axial communicating passages;

an operating lever inserted in said sector-shaped radial hole of the adjusting block and coupled to said rear end of the adjusting rod disposed in the axial hole of the adjusting block, said operating lever being rotatable to make the adjusting rod slide forwardly and backwardly;

control means adapted to control a flow rate of the operating medium flowing between the front and rear operating medium chambers of the first cylinder, said control means including, a pair of axially spaced radial communicating passages extending from an outer circumferential surface of the first piston to the central throughout hole of the first piston;

a communication adjusting groove formed axially at a circumferential surface of a portion of the adjusting rod axially extending between said radial communicating passages, said groove serving to communicate the radial communicating passages with each other selectively according to a rotation of the adjusting rod, but irrespective of the forward and backward sliding movements of the adjusting rod; and said operating lever being movable along the sector-shaped radial hole of the adjusting block to make the adjusting rod rotate.

* * * * *